US006254222B1

(12) United States Patent
Murata et al.

(10) Patent No.: US 6,254,222 B1
(45) Date of Patent: Jul. 3, 2001

(54) LIQUID JET RECORDING APPARATUS WITH FLOW CHANNELS FOR JETTING LIQUID AND A METHOD FOR FABRICATING THE SAME

(75) Inventors: Michiaki Murata; Regan Nayve; Atsushi Fukugawa; Masahiko Fujii, all of Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/200,456

(22) Filed: Nov. 27, 1998

(30) Foreign Application Priority Data

Dec. 11, 1997 (JP) ..... 9-341658
Dec. 11, 1997 (JP) ..... 9-341659
Nov. 4, 1998 (JP) ..... 10-312703

(51) Int. Cl.[7] ..... B41J 2/05; B41J 2/17
(52) U.S. Cl. ..... 347/65; 347/94
(58) Field of Search ..... 347/63, 65, 93, 347/94, 92

(56) References Cited

U.S. PATENT DOCUMENTS

| | | | | |
|---|---|---|---|---|
| 4,774,530 | | 9/1988 | Hawkins | 347/63 |
| 5,132,707 | | 7/1992 | O'Neill | 346/140 R |
| 5,277,755 | | 1/1994 | O'Neill | 156/647 |
| 5,385,635 | | 1/1995 | O'Neill | 156/647 |
| 5,793,393 | * | 8/1998 | Coven | 347/65 |
| 5,971,527 | * | 10/1999 | Peeters et al. | 347/65 |
| 5,988,798 | * | 11/1999 | Hirasawa et al. | 347/65 |

FOREIGN PATENT DOCUMENTS

| | | |
|---|---|---|
| 4-296564 | 10/1992 | (JP) . |
| 5-299409 | 11/1993 | (JP) . |
| 6-183002 | 7/1994 | (JP) . |
| 6-84075 | 10/1994 | (JP) . |
| 7-1729 | 1/1995 | (JP) . |
| 7-156415 | 6/1995 | (JP) . |

OTHER PUBLICATIONS

Bhardwaj, J.K., et al. "Advanced Silicon Etching Using Density Plasmas", *Micromachining and Microfabrication Process Technology*, vol. 2639, Society of Photo–Optical Instrumentation Engineering (SPIE), Oct. 1995, pp. 224–232.

* cited by examiner

*Primary Examiner*—John Barlow
*Assistant Examiner*—Juanita Stephen
(74) *Attorney, Agent, or Firm*—Oliff & Berridge, PLC.

(57) ABSTRACT

Through-holes serving as common liquid chambers 5 are formed in a flow channel substrate 1 by a wet anisotropic etching process. One opened end of each through-hole serves as a liquid inlet 4. Trenches rectangular in cross section, which are used as liquid flow channels 7, are formed in the flow channel substrate by RIE process. Each liquid flow channel 7 includes a front constriction 41 formed near its associated discharge orifice 9 and a rear constriction 42 formed near a connection portion between the channel and the common liquid chamber 5. The common liquid chamber 5 is communicatively connected to the liquid flow channel 7 in a linear fashion, and a portion of the liquid flow channel 7 between the front constriction 41 and the rear constriction 42 may be designed to be broad. Therefore, the flow channel resistance is reduced, the liquid jetting efficiency is improved, and the liquid re-supplying is performed at high speed.

9 Claims, 15 Drawing Sheets

A
A'

LIQUID JET RECORDING APPARATUS WITH FLOW CHANNELS FOR JETTING LIQUID AND A METHOD FOR FABRICATING THE SAME

BACKGROUND OF THE INVENTION

The present invention relates to a liquid jet recording apparatus which applies energy to liquid held in a liquid channel and spouts the liquid outside through a discharge orifice, and a method for fabricating the same.

FIG. 19 is a perspective view exemplarily showing a conventional liquid jet recording apparatus, and FIG. 20 is across sectional view taken on line A in FIG. 19. In those figures, reference numeral 1 is a flow channel substrate; 2 is an element substrate; 3 is a thick layer; 4 is a liquid inlet; 5 is a common liquid chamber; 6 is a by-pass channel; 7 is a liquid flow channel; 8 is a heating resistor element; 9 is a discharge orifice; and 10 is a stepped portion. The illustrated liquid jet recording apparatus is of the thermal type. In this type of the apparatus, the energy converting element for converting electric energy to thermal energy is the heating resistor element 8. The liquid jet recording apparatus is disclosed in Japanese Patent Laid-Open Publication No. Hei 6-183002, for example. The energy converting means may be a piezoelectric element or the like.

The flow channel substrate 1 may be made of silicon, for example. Trenches to be used as a number of liquid flow channels 7 and a through-hole to be used as the common liquid chamber 5 are formed in the flow channel substrate 1 by an anisotropic etching method. One end opening of the through-hole serves as the liquid inlet 4. The common liquid chamber 5 is formed in two steps to have the stepped portion 10 by anisotropic etching process. The element substrate 2 may also be made of silicon, for example. The heating resistor element 8, which are associated with the liquid flow channel 7, are formed on the element substrate 2, and wires and drive circuits to supply electric energy to the heating resistor element 8 are further formed in the element substrate. The thick layer 3 made of polyimide, for example, is layered on those elements, wires and circuits on the element substrate. The thick layer 3 is removed of its regions for the by-pass channels 6 interconnecting the liquid flow channels 7 and the common liquid chamber 5, which are formed in the flow channel substrate 1, and the regions above the heating resistor element 8. The thick layer 3 is required for forming the by-pass channels 6, and serves as a passivating layer for protecting the wires and drive circuits formed in the surface of the element substrate 2 against liquid attack. The flow channel substrate 1 and the element substrate 2, which are thus formed, are aligned in position with each other, and bonded together.

FIG. 21 is a cross sectional view showing a liquid jet recording apparatus equipped with a manifold. In the figure, reference numeral 11 is a manifold and 12 is an adhesive. After the liquid jet recording apparatus as shown in FIG. 19 is manufactured, the manifold 11 is attached to the liquid jet recording apparatus in order to supply liquid from a liquid tank to the liquid inlet 4 of the apparatus. To attach the manifold, the adhesive 12 is applied to a portion around the liquid inlet 4 of the liquid jet recording apparatus, and the manifold 11 is bonded to the apparatus and liquid tightly sealed so as to prevent liquid from leaking outside.

In the general liquid jet recording apparatus, its purging and jetting performance depends largely on the length of the liquid flow channel if the cross sectional areas of the liquid flow channels 7 are equal to one another. Therefore, where the channel length becomes long, the flow channel resistance increases, and the amount of energy necessary for jetting the liquid becomes large or the amount of jetted liquid becomes small. This fact teaches that to design a high efficiency liquid jet recording apparatus, the length of the liquid flow channels 7 is reduced as short as possible.

If the channel length (length a in FIG. 21) of the liquid flow channel 7 is reduced, the common liquid chamber 5 is shifted to the discharge orifice 9, and the distance from the surface having an array of discharge orifices 9 to the liquid inlet 4, viz., the length b in FIG. 21, is reduced. As recalled, the portion around the liquid inlet 4 is coated with the adhesive 12, and the manifold 11 is attached and bonded to the adhesive coated portion. Therefore, if the length b between the orifice-arrayed surface and the liquid inlet 4 is short, there is a chance that the adhesive 12 applied enters into the apparatus through the liquid inlet 4. In this case, the adhesive obstructs the flow of liquid inside the apparatus, possibly causing a trouble of printing. As seen from the above facts, it is required that the channel length a of the liquid flow channel 7 is reduced as short as possible, but the length b between the orifice-arrayed surface and the liquid inlet 4 is selected to such an extent as to avoid the printing trouble. The liquid jet recording apparatus constructed as shown in FIGS. 20 and 21 uses the stepped portion 10 to satisfy the above requirements, and to improve a production yield in the manufacturing of the liquid jet recording apparatus.

The liquid for recording is supplied through the liquid inlet 4 into the liquid jet recording apparatus, and flows in the direction of an arrow in FIG. 20. The liquid flows from the liquid inlet 4 to the common liquid chamber 5, passes through the by-pass channel 6 which is formed by removing the thick layer 3, and reaches the liquid flow channel 7.

In the instance mentioned above, the flow channel substrate 1 consists of a silicon substrate. A wet anisotropic etching method using a medicine liquid, e.g., KOH solution, is known for a method for fabricating trenches serving as the liquid flow channels 7 and the through-holes as the common liquid chambers 5, as disclosed in U.S. Pat. No. 5,277,755.

FIGS. 22A to 22I are views showing a method for fabricating a liquid flow channel substrate of a conventional liquid jet recording apparatus. In the figure, reference numeral 31 designates a silicon substrate; 32 is an $SiO_2$ film; and 33 is an SiN film.

1) FIG. 22A

A silicon substrate 31 to be used as the flow channel substrate 1 is arranged.

2) FIG. 22B

A $SiO_2$ film 32 is formed on the silicon substrate 31 by thermal oxidation process.

3) FIG. 22C

The $SiO_2$ film 32 is patterned to form the liquid flow channels 7 including the discharge orifices and the common liquid chamber 5 therein by a photolithography method and a dry etching method. The silicon substrate 31 used has a lattice face <100>.

4) FIG. 22D

An SiN film 33 is formed over the resultant structure by a pressure-reduction CVD method.

5) FIG. 22E

The SiN film 33 is patterned to form portions in which the common liquid chambers 5 are to be formed by photolithography and dry-etching process.

6) FIG. 22F

With a mask of the SiN film 33, the silicon substrate 31 is etched in a KOH solution. The etching process is continued till a through-hole is formed in the silicon substrate 31, and the formed through-hole is used as the liquid inlet 4.

7) FIG. 22G

The SiN film 33 is removed.

8) FIG. 22H

Using the $SiO_2$ film 32 as an etching mask, the silicon substrate 31 is etched in a KOH solution to form trenches to be the liquid flow channels 7. In the etching process, the regions of the common liquid chambers 5 are etched to form the stepped portions 10.

9) FIG. 22I

Finally, the $SiO_2$ film 32 is selectively etched away in a hydrofluoric acid solution to complete the silicon substrate 31 to be used as the flow channel substrate 1.

FIG. 23 is a plan view exemplarily showing a silicon substrate 31 to be used as the liquid flow channel substrate of the conventional liquid jet recording apparatus. Trenches serving as the liquid flow channels 7 and the through-holes to be used as the common liquid chambers 5 and the liquid inlet 4, which correspond to a number of liquid flow channel substrates, are formed in the silicon substrate 31 through the manufacturing steps as shown in FIG. 22. The silicon substrate 31 is bonded to a silicon substrate 31 including a number of element substrates 2 formed thereon, and the substrate body by the bonding of the silicon substrates is then cut into individual liquid jet recording apparatuses by dicing. A portion including an array of liquid flow channels 7 in each liquid jet recording apparatus is cut along a nozzle dicing line (indicated by a dotted line shown in FIG. 23) by dicing. The liquid flow channels 7 of the apparatus are opened in the cutting surface thereof. The openings of the liquid flow channels 7 serve as the discharge orifices 9.

As described above, the conventional method of fabricating the liquid jet recording apparatus uses the wet anisotropic etching process using the KOH solution to form the flow channel substrate 1. The wet anisotropic etching process is advantageous in that when the substrate is square when viewed in plan, the etching accuracy is high and when the substrate is etched deep as in forming the common liquid chamber 5, the etching rate is relatively high. At this time, a shape of the cross sectional area of the silicon substrate 31 is determined by the lattice face <100>of the substrate, usually trapezoidal or triangular. It is for this reason that the liquid flow channel 7 and the discharge orifice 9, which are formed by the wet anisotropic etching process, are triangular in cross section.

With the recent trend toward high resolution in the liquid jet recording apparatus, the pitch of the orifice array becomes smaller. In the conventional liquid jet recording apparatus, the liquid flow channels 7 and the discharge orifices 9 are uniformly triangular in cross section. Therefore, when the discharge orifice 9 is reduced in size, the cross sectional area of the liquid flow channel 7 is also reduced, so that the flow channel resistance in the liquid flow channel 7 is increased. Further, in the conventional apparatus, a part of the fluid channel like the by-pass channel is narrow and bent as shown in FIG. 20, and hence the flow channel resistance is increased.

The increase of the flow channel resistance creates the following problems. In the liquid jet recording apparatus, the resistive heater element is instantaneously heated to generate air bubbles in the liquid, and energy generated when the bubbles grow is utilized to jet liquid through the discharge orifice. Where the flow channel resistance in a portion of the channel ranging from the resistive heater element to the discharge orifice is increased, pressure generated during the growing of bubbles is inefficiently transferred to the discharge orifice. As a result, electric energy to be applied to the resistive heater element every jetting of the liquid increases. Where the flow channel resistance in another portion of the channel ranging from the common liquid chamber to the discharge orifice is increased, much time is taken till the liquid is jetted and then is re-supplied to the discharge orifice, so that a recording speed is reduced. The liquid must be sucked from the discharge orifice to stabilize the jetting operation, for example. In this case, a large pump is required for the suction. Use of the large pump leads to increase of the apparatus size.

To cope with this, the designer has attempt to use the structure where the cross sectional area of the liquid flow channel is increased but the cross sectional area of the orifice portion is decreased viz., a called constrained structure. In this connection, the thermal ink jet printer in which the channel portions located before and after the channel having the cross sectional area of 70×40 $\mu$m are each 60×42 $\mu$m in cross section is disclosed in the Unexamined Japanese Patent Application Publication No. Hei 7-1729. No description of a channel structure ranging from the liquid flow channel to the common liquid chamber is given in the publication, and description of the fabricating method is unclear.

The Unexamined Japanese Patent Application Publication No. Hei 7-156415 (U.S. Pat. No. 5,385,635) discloses such a printhead that the opening of the etch resistant mask is configured to increase in the middle portion of the liquid flow channel when the anisotropic etching process is applied. Also in this printhead, a part of the liquid flow channel is narrowed and bent as the by-pass channel, and as a result, the flow channel resistance increases.

Another printhead is disclosed in the Unexamined Japanese Patent Application Publication No. Hei 4-296564 (U.S. Pat. No. 5,132,707). In the printhead, the liquid flow channel is entirely formed with a thick film material, and the nozzle portion is constricted when viewed in plane. Actually, it is technically difficult to accurately fabricate the entire liquid flow channel with the thick film material.

The Examined Japanese Patent Application Publication No. Hei 6-84075 discloses another printhead designed such that a recess deep to such an extent as not to shut off the liquid flow channel is formed in the ceiling near a thermal energy acting portion, and the recess is used to supplementarily supplying recording liquid. The approach by merely recessing the ceiling near the thermal energy acting portion fails to solve the problem of the flow channel resistance increase.

SUMMARY OF THE INVENTION

Accordingly, an object of the present invention is to provide a liquid jet recording apparatus which allows the high resolution design of the apparatus, improves the liquid jetting efficiency, and records at high speed, and a method for fabricating such a liquid jet recording apparatus at high production yield.

The present invention employs a reactive ion etching (RIE) method to form trenches serving as liquid flow channels in a liquid flow channel substrate. This RIE process has no crystal-orientation dependency. Because of this, the RIE process can accurately form a desired shape viewed in plane, and hence form a portion constrained in plane. Therefore, the RIE process can form a liquid flow channel being capable of efficiently forwarding the liquid toward the nozzle, and re-supplying the liquid at high speed. Hence, the resultant printhead is advantageous in that the energy efficiency is good and the recording or printing speed is high.

For the RIE process, reference is made to Micromachining and Microfabrication Process Technology, Volume 2639, 1995, Society of Photo-Optical Instrumentation Engineering (SPIE), U.S.A. J. K. Bhardwaj, H. Ashraf, "Advanced Silicon Etching Using Density Plasmas", pp 224–232.

The RIE process can form the trenches oriented at a right angle to the surface of the Si substrate. Therefore, the liquid channels and the openings or orifices of the nozzles may be rectangularly shaped in cross section. Further, the etching depth may be set at a desired level. Therefor, in a case where the liquid flow channels are arrayed at high density and the width of the liquid jet recording apparatus is reduced, the cross sectional area of each channel may satisfactorily be increased so as to produce a desired volume of liquid drop by increasing the channels in their height. Thus, the present invention can allows a designer to design the liquid jet recording apparatus of high resolution performance.

A recess may be formed on and along the bottom of each of the thus formed trenches substantially rectangular in cross section, while extending in the liquid flow channel extending direction. With the formation of the recess, the cross sectional area of the liquid flow channel is increased and the flow channel resistance in the liquid flow channel portion is further reduced. The recesses may be formed by the anisotropic etching method, for example. In this case, the cross section of each recess is substantially triangular or trapezoidal. The cross section of the liquid flow channel with the recess takes a polygonal figure having at least five straight lines.

The recesses that are formed extending to near the nozzle orifices may be used as constricted portions in the thickness direction of the liquid flow channel substrate. Further, if the portions having substantially rectangular cross sectional areas are reduced in height, each of those portions is constricted in three sides, i.e., two elevational sides and the recessed bottom. As a result, the liquid can be more forcibly jetted through the nozzle orifices.

DETAILED DESCRIPTION OF THE PREFERRED EMBODIMENTS

Figure 1:
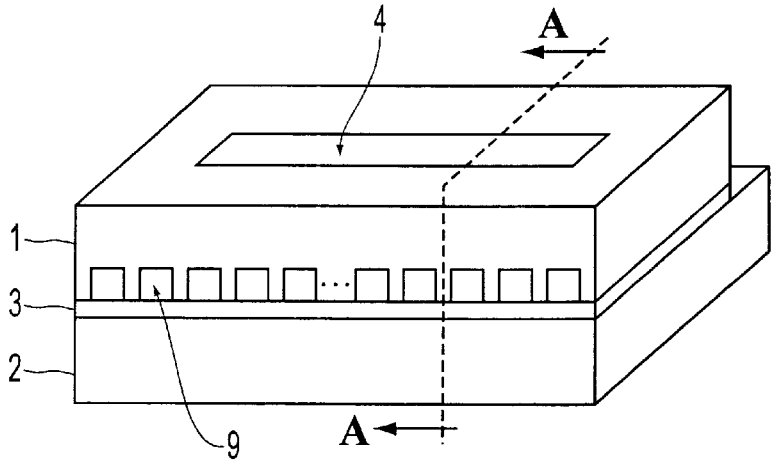
FIG. 1 is a perspective view showing a liquid jet recording apparatus which is an embodiment of the present invention.
Figure 2:
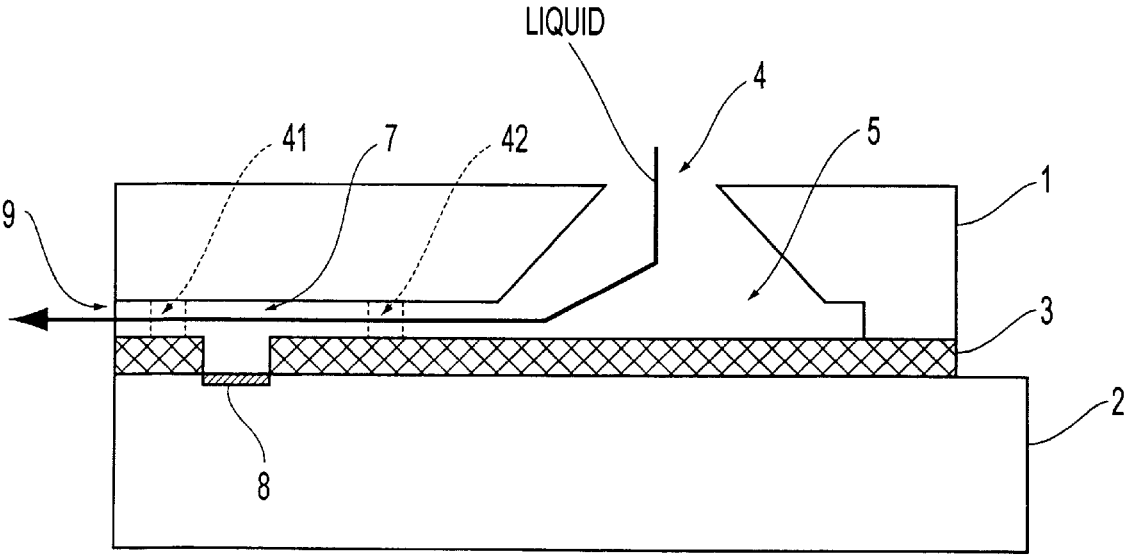
FIG. 2 is a cross sectional view taken on line A in FIG. 1.
Figure 3:
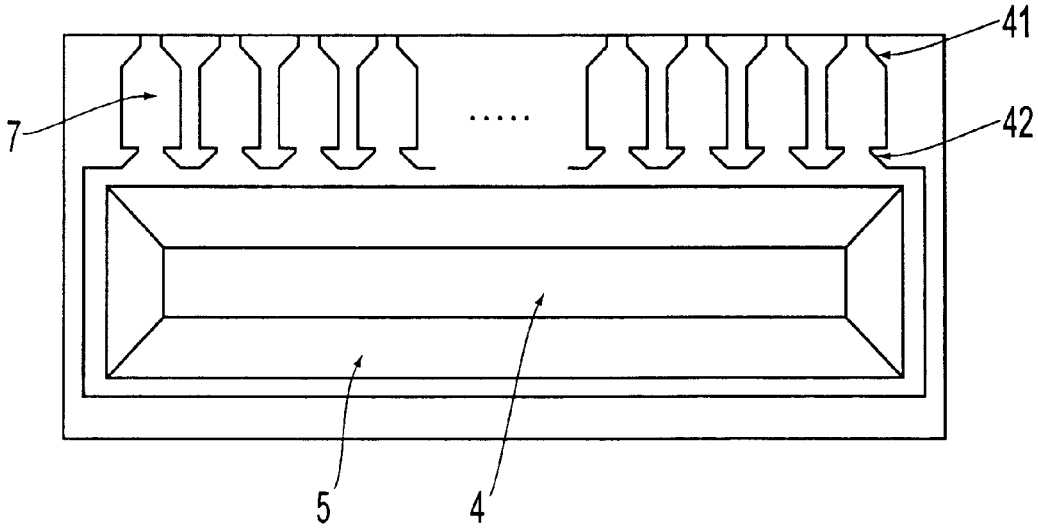
FIG. 3 is a plan view showing an exemplar liquid channel substrate in the FIG. 1 apparatus.
Figure 4A:
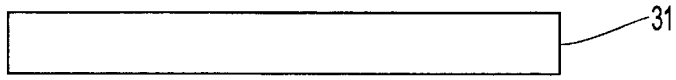
FIGS. 4A to 4I are views showing sequential steps of a method for fabricating a liquid channel substrate of the liquid jet recording apparatus of the first embodiment.
Figure 4B:
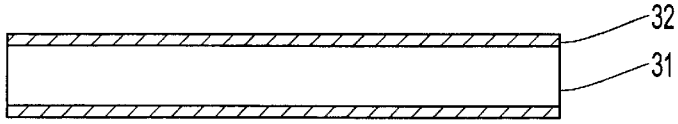
Figure 4C:
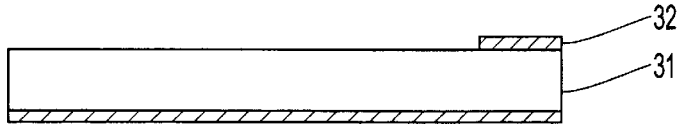
Figure 4D:
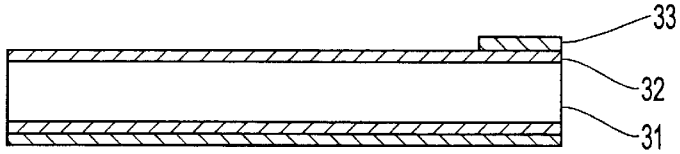
Figure 4E:
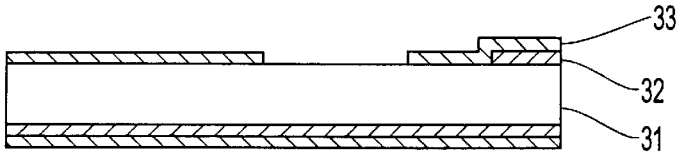
Figure 4F:
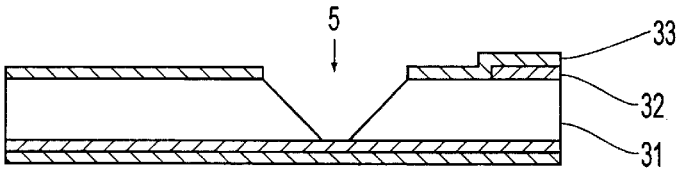
Figure 4G:
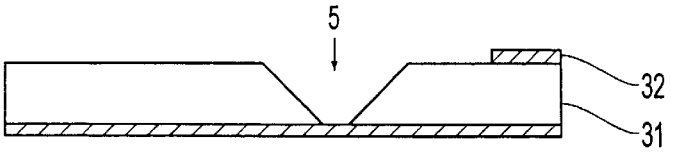
Figure 4H:
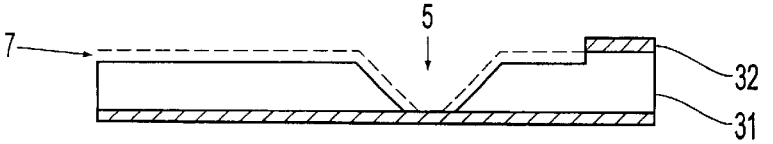
Figure 4I:
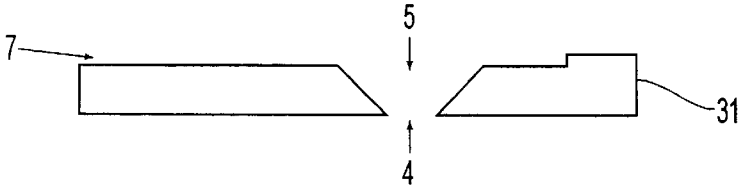
Figure 19:
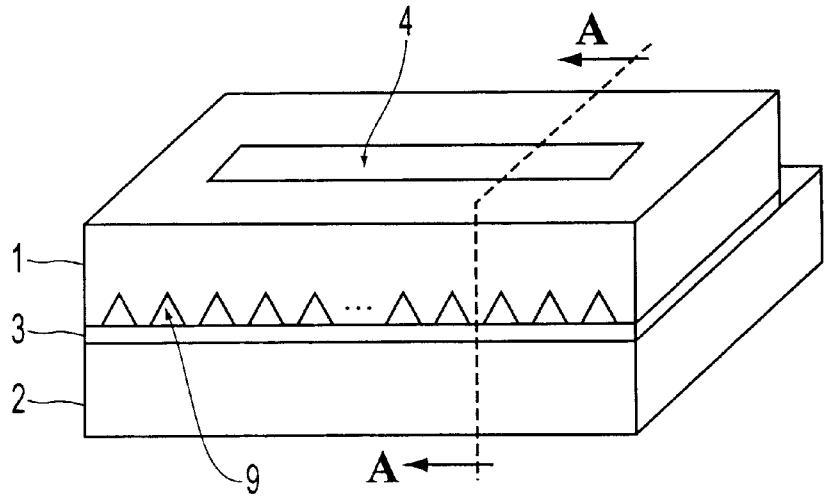
FIG. 19 PRIOR ART
FIG. 19 is a perspective view exemplarily showing a conventional liquid jet recording apparatus.
Figure 20:
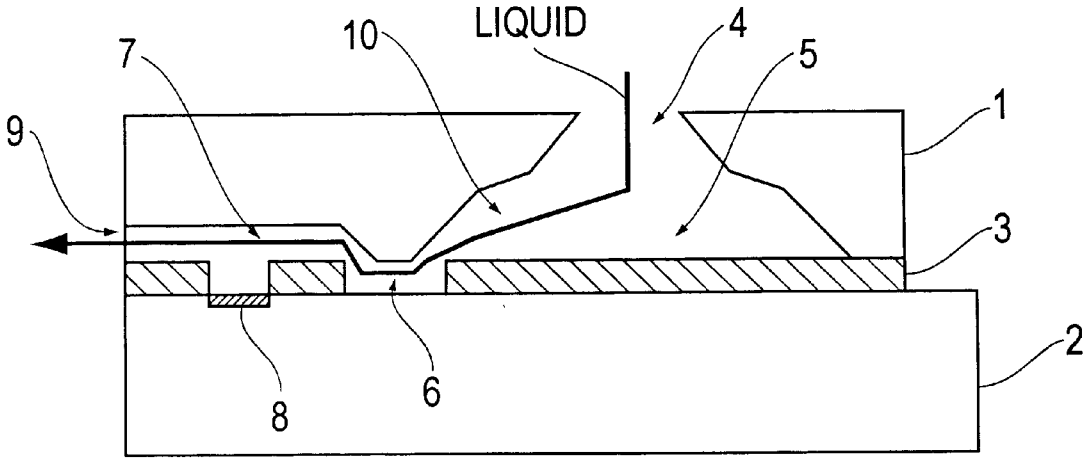
FIG. 20 PRIOR ART
FIG. 20 is a cross sectional view taken on line A in FIG. 19.

FIG. 1 is a perspective view showing a liquid jet recording apparatus which is an embodiment of the present invention. FIG. 2 is a cross sectional view taken on line A in FIG. 1. FIG. 3 is a plan view showing an exemplar liquid flow channel substrate in the FIG. 1 apparatus. In those figures, like or equivalent portions are designated by like reference numerals in FIGS. 19 and 20. Reference numerals 41 and 42, additionally used, are a front constriction and a rear constriction, respectively. The liquid jet recording apparatus to be discussed is of the thermal type. This type liquid jet recording apparatus uses a heating resistor element 8 for an energy converting element for converting electric energy to thermal energy. Another suitable energy converting element, e.g., a piezoelectric element, may also be used for the same, as a matter of course.

The flow channel substrate 1 may be formed of silicon, for example. As in the prior apparatus, a through-hole to be used as the common liquid chamber 5 is formed in the flow channel substrate 1 by an anisotropic etching method. One end opening of the through-hole is the liquid inlet 4. Trenches to be used as a number of liquid flow channels 7, which are each substantially rectangular in cross section, are formed in the flow channel substrate 1 by an RIE method. The common liquid chamber 5 is directly connected to the liquid flow channels 7 (FIG. 2), and each liquid flow channel 7 is provided with a front constriction 41 and a rear constriction 42 (FIGS. 2 and 3).

As best illustrated, a portion of the rear constriction 42, which is located closer to the common liquid chamber 5, is configured to gradually decrease its width toward its associated discharge orifice 9. The rear constriction 42 thus configured reduces a flow channel resistance in the flowing of liquid from the common liquid chamber 5 into the space above the heating resistor element 8, to thereby avoid the degradation of the liquid supplying performance. Another portion of the rear constriction 42, located closer to the discharge orifice 9, is configured to be substantially orthogonal to the direction of the liquid flow. The thus configured portion of the rear constriction 42 blocks the propagation of a pressure, which is generated during the growing of bubbles generated above the heating resistor element 8, toward the common liquid chamber 5, while guiding the pressure toward the discharge orifice 9. With this structure, the pressure generated during the bubble growing is efficiently utilized and hence the energy efficiency of the apparatus is improved. Additionally, it lessens an adverse effect on other liquid flow channels, viz., cross talk.

The front constriction 41 of each liquid flow channel 7 becomes narrow toward its associated discharge orifice 9 when viewed in plan. The front constriction 41 thus configured functions to concentrate the pressure, which is produced during the growing of bubbles that are generated above the heating resistor element 8, into the discharge orifice 9. As a result, the energy efficiency of the apparatus is improved and a spouting speed of a liquid drop that is spouted out of the discharge orifice 9 is increased. The increase of the spouting speed stabilizes the recording or printing operation and keeps the print quality high.

It will readily be understood that the configurations of the front constriction 41 and the rear constriction 42 are not limited to the illustrated ones, but these constrictions may take other suitable configurations. The front constriction 41 and/or the rear constriction 42 may be omitted, if necessary.

In the liquid jet recording apparatus thus constructed, liquid enters the common liquid chamber 5 through the liquid inlet 4 and flows to the liquid flow channel 7. The liquid passes through the rear constriction 42 of the liquid flow channel 7 and reaches the space above the heating resistor element 8. The liquid is heated by the heating resistor element 8 to generate air bubbles in the liquid. A pressure is generated when the bubbles grow, and by the pressure, the liquid is constricted by the rear constriction 42 and is ejected through the discharge orifice 9.

In such a structure that each liquid flow channel 7 is directly connected to the common liquid chamber 5, there is no chance that liquid flows through the by-pass channel extremely small in cross section, whereby the flow channel resistance is reduced. The result is that the performance to supply liquid to the liquid flow channels 7 is improved, a reduced time is taken till the structure is ready for jetting the next liquid drop, and hence a recording speed is increased.

Each liquid flow channel 7 and each discharge orifice 9 are configured to be rectangular in cross section by the RIE method. By the way, the liquid flow channels 7 and the discharge orifices 9 must be arrayed in high density in order to realize the high resolution performance. Also in this case, it is necessary to secure a proper amount of liquid drop. In the conventional structure using the liquid flow channels 7 formed by the wet anisotropic etching method, when the width of the liquid flow channel 7 is reduced, the cross sectional area of the liquid flow channel 7 is reduced in proportion to the square of a value of width reduction. As a result, the amount of liquid drop is remarkably reduced. In this connection, to increase the density of the arrays of the liquid flow channels 7 and the discharge orifices 9, the present invention can secure the necessary amount of liquid drop by increasing the height (depth) of the liquid flow channel 7 and the discharge orifice 9. In this respect, the liquid jet recording apparatus of the invention allows the designer to design the liquid jet recording apparatus of the high resolution performance. Further, the increase of the cross sectional area of the liquid flow channel 7 leads to reduction of the flow channel resistance of the liquid flow channel 7, and hence to the improvement of the energy efficiency.

The individual liquid jet recording apparatuses each as shown in FIG. 1 are produced by dicing, and then the surface having discharge orifices 9 (nozzle surface) of the apparatus is sometimes subjected to a surface treatment. To the surface treatment, the nozzle surface of the liquid jet recording apparatus is immersed into a surface treatment solution, and the treatment liquid sticks to the nozzle surface. In this case, the coating around the discharge orifices 9 being rectangular in cross section is more uniform than that around the discharge orifices 9 being triangular.

A liquid jet recording apparatus thus constructed according to the present invention and a conventional liquid jet recording apparatus were tested for comparatively examining their jetting performances. The test results were: The apparatus of the invention could jet liquid drops at higher speed than the conventional apparatus, and the former requires smaller energy to jet the liquid drop than the latter. Thus, it was confirmed that the apparatus of the invention succeeded in remarkably improving the jetting efficiency.

FIGS. 4A to 4I are views showing sequential steps of a method for fabricating a liquid flow channel substrate of the liquid jet recording apparatus of the first embodiment. In FIGS. 4A to 4I, like portions are designated by like reference numerals in FIGS. 22A to 22I.

1) FIG. 4A

A silicon substrate 31 serving as a flow channel substrate 1 is arranged.

2) FIG. 4B

A $SiO_2$ film 32 is formed over the silicon substrate 31 by a thermal oxidation method. In this case, the $SiO_2$ film 32 may have a thickness of about 1 $\mu$m.

3) FIG. 4C

Figure 5:
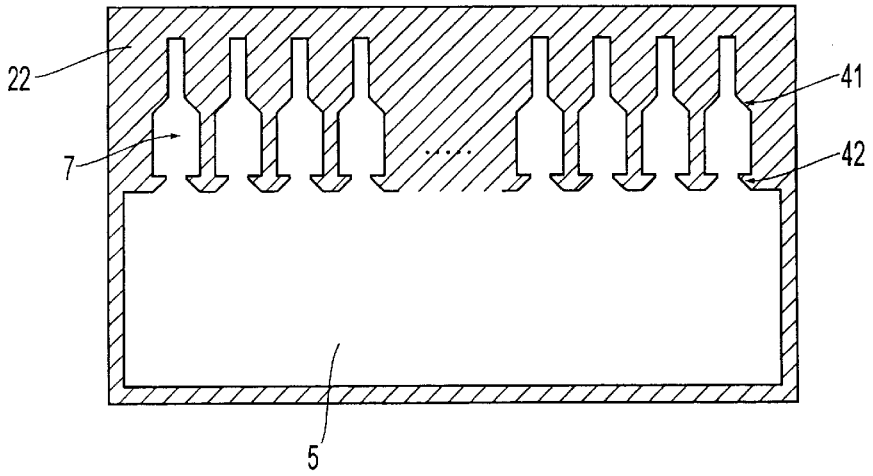
FIG. 5 is a plan view exemplarily showing a pattern of the $SiO_2$ film 32 formed by the method for fabricating a liquid channel substrate of the liquid jet recording apparatus of the first embodiment.

The $SiO_2$ film 32 is patterned to form portions serving as liquid flow channels 7 with discharge orifices 9 and portions serving as common liquid chambers 5 by a photolithography method and a dry etching method. The silicon substrate 31 used has a lattice face <100>. FIG. 5 is a plan view exemplarily showing a pattern of the $SiO_2$ film 32. In the present invention, liquid flow channels 7 as shown in FIG. 3 are formed in the flow channel substrate 1. As shown in FIG. 5, the liquid flow channels 7 are engraved to form a comb-like pattern such that the handle of the comb corresponds to a common liquid chamber 5 and the teeth of it correspond to the liquid flow channels 7. A rear constriction 42 is formed in the vicinity of the boundary between the common liquid chamber 5 and each liquid flow channel 7, and a front constriction 41 is formed at a position of the liquid flow channel 7 just below the discharge orifice 9 to narrow a part of the liquid flow channel 7 the extremity of which is opened to form the discharge orifice 9. Use of one of the front constriction 41 and the rear constriction 42 is allowed.

4) FIG. 4D

An SiN film 33 is formed by a low-pressure CVD method. In this case, a thickness of the SiN film 33 may be about 300 nm.

5) FIG. 4E

The SiN film 33 is patterned to form portions therein serving as common liquid chambers 5 by a photolithography method and a dry etching method. Each region of the SiN film 33 to be etched away is sized to be preferably smaller than an actual common liquid chamber 5 by a predetermined value of size.

6) FIG. 4F

The silicon substrate 31 is selectively etched in a KOH solution, while using the SiN film 33 as a mask. The etching process is continued till through-holes are formed in the silicon substrate 31. Those through-holes are used as liquid inlets 4. A wet anisotropic etching method is used for the etching process as in the conventional method. As described above, the regions of the SiN film 33 to be etched away are smaller in size than actual common liquid chambers 5 by the predetermine value. Therefore, the common liquid chambers 5 formed in this step are smaller than the actual ones by the predetermined value. The inner wall of each through-hole thus formed is slanted at a predetermined angle. To form the through-holes, the etching is applied to one of the surfaces of the silicon substrate 31. Because of this, the through-hole reduces its cross sectional area toward the liquid inlet 4. In the wet anisotropic etching used here, the etching rate is higher than in the RIE (reactive ion etching), and hence is suitable for the etching made deep so as to form, for example, the through-hole passing through the flow channel substrate 1.

7) FIG. 4G

Subsequently, the SiN film 33 is selectively etched away in a phosphoric acid solution.

8) FIG. 4H

Figure 6:
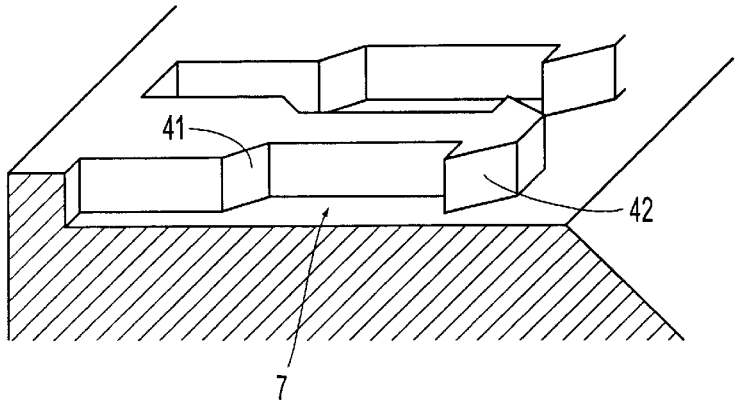
FIG. 6 is a perspective view, partly broken, showing a region in the vicinity of the liquid flow channels 7 in the Si substrate when it is subjected to the RIE process.

With an etching mask of the $SiO_2$ film 32, the silicon substrate 31 is subjected to RIE process to form trenches to be used as liquid flow channels 7. The RIE process can etch other regions of the silicon substrate 31 than the masked ones in a uniform thickness, while being not dependent on the crystal orientation of silicon. FIG. 6 is a perspective view, partly broken, showing a region in the vicinity of the liquid flow channels 7 in the Si substrate when it is subjected to the RIE process. By using the $SiO_2$ film 32 as an etching mask as shown in FIG. 5, the RIE can etch the silicon substrate in the depth direction to form the liquid flow channels 7 being uniform in depth, even if those are complicated in structure.

The forming accuracy of the liquid flow channels 7 greatly affects the liquid injection characteristic. The wet anisotropic etching process can accurately form a pattern rectangular in plan; however, it cannot accurately form a complicated planar pattern as shown in FIG. 5. The RIE process used in the present invention can accurately form a planar pattern of the liquid flow channels 7, even if complicated in shape, having a desired jetting characteristic. Further, the RIE process is free from such a disadvantage, essential to the wet etching process, that a planar size limits the etching depth.

The RIE process etches the portions of the common liquid chamber 5 in the silicon substrate 31 to the depth equal in level to that of the liquid flow channels 7. The RIE process expands the portions of the common liquid chambers, which were formed to be smaller in size than the actual ones in the process step of FIG. 4F into the portions having the same size as of the actual ones.

9) FIG. 4I

The $SiO_2$ film 32 is selectively etched away in a hydrofluoric acid solution to complete the fabrication method to the silicon substrate 31 to be used as the flow channel substrate 1. FIG. 1 is a plan view showing an example of an silicon substrate 31 which will be used as the flow channel substrate 1 in the liquid jet recording apparatus as the first embodiment of the present invention. The silicon substrate 31 includes a number of liquid channel substrates each including the trenches serving as the liquid flow channels 7 having the front constrictions 41 and the rear constrictions 42, the common liquid chamber 5 and the through-hole, which are formed by the fabricating method as shown in FIG. 4.

Another silicon substrate 31 including a number of element substrates 2 is fabricated by another fabricating method. Energy converting elements associated with the liquid flow channels 7, wires for supplying electric energy to the energy converting elements, and, if necessary, drive circuits are formed in the element substrate 2. In this instance, heating resistor elements are used for the energy converting elements. A thick layer 3 made of polyimide, for example, is layered over the element substrate 2. The thick layer 3 protects the elements, wires and the like in the element substrate 2 against liquid attack. The portions of the thick layer 3 above the heating resistor elements are removed. Protecting films, for example, are formed on the heating resistor elements.

Figure 7:
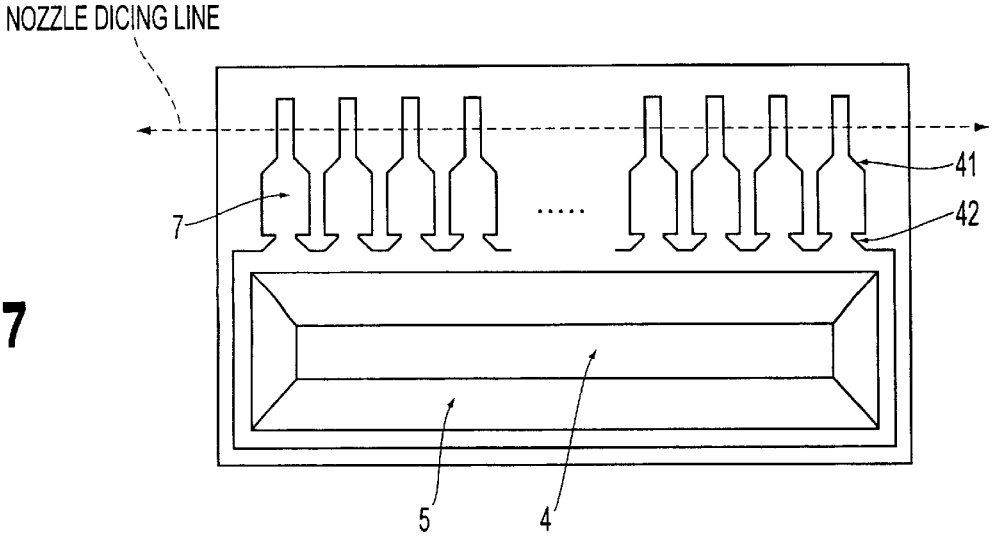
FIG. 7 is a plan view exemplarily showing a silicon substrate 31 to be used as the liquid channel substrate of the conventional liquid jet recording apparatus of the first embodiment.

The silicon substrate 31 including a number of liquid flow channel substrates 1 and the silicon substrate including a number of element substrates are aligned with each other and bonded together. As the result of the bonding of those substrates, the flow channel substrate 1 and the thick layer 3 on the element substrates 2 defined the liquid flow channels 7. The substrate body resulting from the bonding of those substrates is cut into individual liquid jet recording apparatuses by dicing. A portion including an array of the liquid flow channels 7 in each liquid jet recording apparatus is cut along a nozzle dicing line (indicated by a broken line in FIG. 7) by dicing. The liquid flow channels 7 of the apparatus are opened in the cutting surface thereof. The openings of the liquid flow channels 7 serve as the discharge orifices 9. Each discharge orifice 9 is rectangular in cross section since the trenches for the liquid flow channels 7 were formed in the silicon substrate 31 by the RIE process.

Figure 8:
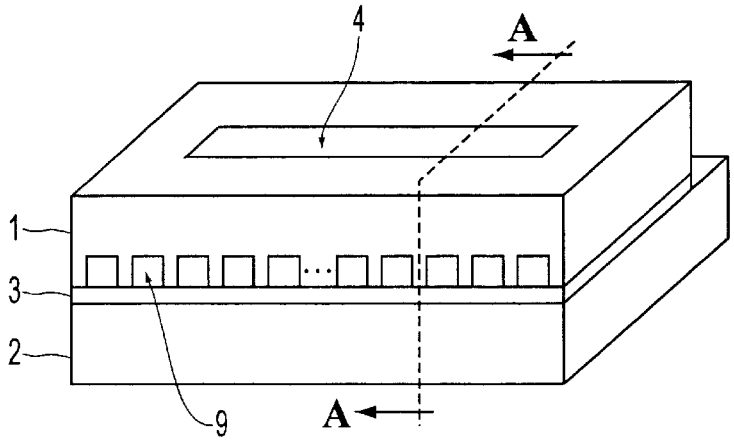
FIG. 8 is a perspective view showing a liquid jet recording apparatus which is a second embodiment of the present invention.
Figure 9:
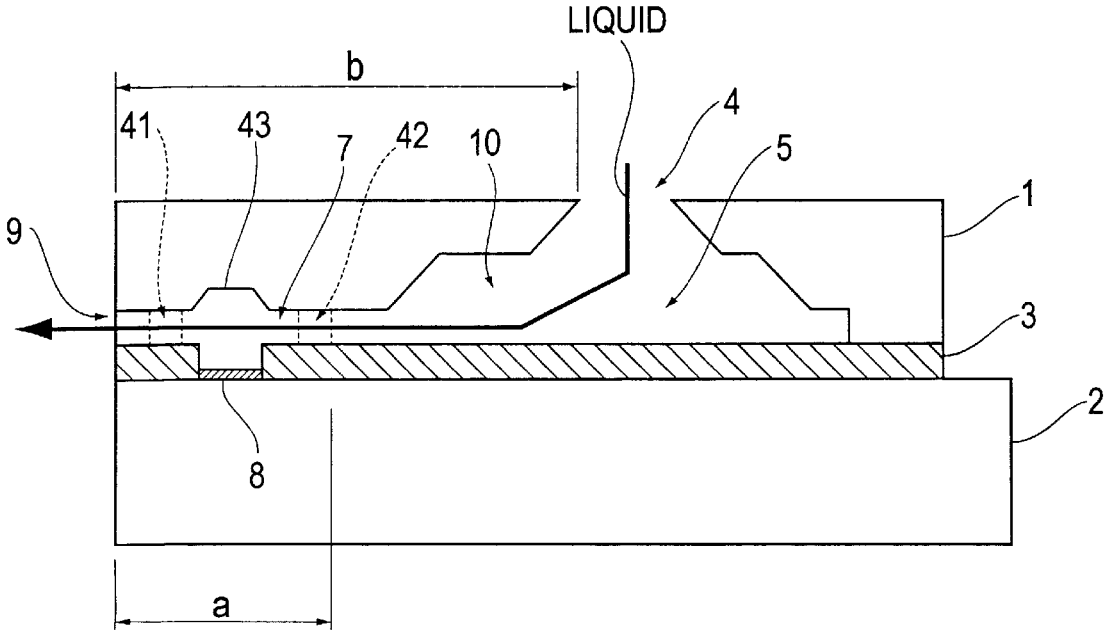
FIG. 9 is a cross sectional view taken on line A in FIG. 8.

FIG. 8 is a perspective view showing a liquid jet recording apparatus which is a second embodiment of the present invention. FIG. 9 is a cross sectional view taken on line A in FIG. 8. In those figures, like or equivalent portions are designated by like reference numerals in FIGS. 3, 19 and 20. In FIG. 9, reference numeral 43 is a depression. In the second embodiment, the cross sectional area of the liquid flow channel 7 is larger than that of the liquid flow channel 7 in the first embodiment, whereby the channel resistance is reduced. A stepped portion 10 extends from the side of the common liquid chamber 5 that is located closer to the liquid flow channel 7.

The depression 43 is formed in the bottom of the trench, rectangular in cross section, for the liquid flow channel 7, while extending in the length direction of the liquid flow channel 7. A Si substrate having a lattice face <100> is patterned by wet anisotropic etching process, and is subjected to RIE process. As a result, the patterns formed by the wet anisotropic etching process remain in the trenches formed by the RIE. By utilizing this phenomena, elongated depressions 43 are formed in the portions for the liquid flow channels 7 in the Si substrate to be used as the flow channel substrate 1, by wet anisotropic etching process, and then processed by the RIE.

The depression 43 increases the volume of the space within the liquid flow channel 7. The space where air bubbles are generated and grow above the heating resistor element 8 is expanded to thereby control movement of the bubbles to the discharge orifice 9 or the common liquid chamber 5, and hence to stabilize the liquid drop jetting characteristic. The expansion of the space is equivalent to increase of the cross sectional area of the liquid flow channel 7, and the fact leads to reduction of the flow channel resistance. The result is to improve the liquid resupply characteristic and the energy efficiency.

As already stated in the description of the first embodiment, the trenches for the liquid flow channels 7 may be formed having a desired depth by the RIE process in the design of the high resolution apparatus. The expanding of the volume of the space within the liquid flow channel 7 by one RIE process enlarges the opening of the liquid flow channel 7, or the discharge orifice 9. To avoid this, if the Si substrate is patterned for the depressions 43 by another fabricating method step, the depressions 43 may be formed in the bottom of the liquid flow channel 7 by the RIE process. By so processed, the volume of the spaces within the liquid flow channels 7 can be increased without changing the opening areas of the liquid flow channels 7, or the areas of the discharge orifices 9. Hence, the satisfactory volume of ink drops is secured. For this reason, the present invention succeeds in providing the liquid jet recording apparatus improved in its resolution performance.

The elongated depressions 43 may be formed by a wet anisotropic etching process. When the wet anisotropic etching process is employed, the resultant depression 43 are each substantially triangular or trapezoidal in cross section. The formed depression 43 has slanted surfaces or side walls. The surface or side wall of the depression 43, located closer to the discharge orifice 9, is slanted toward the discharge orifice 9, as seen also from FIG. 9. The structure including the depression 43 having the surface slanted toward the discharge orifice 9 functions to concentrate the pressure during the growing of the bubbles onto the discharge orifice 9. Together with the rear constriction 42, a structure constricted vertically (viewed in FIG. 9) is formed in the portion of the liquid flow channel 7 closer to the common liquid chamber 5. This structure impedes the propagation of the pressure toward the common liquid chamber 5, the pressure being generated during the growing of air bubbles generated above the heating resistor element 8, while guiding the pressure to the discharge orifice 9. The energy efficiency is thus improved. Further, the adverse effect on other liquid flow channels, i.e., cross talk, is also reduced.

Figure 21:
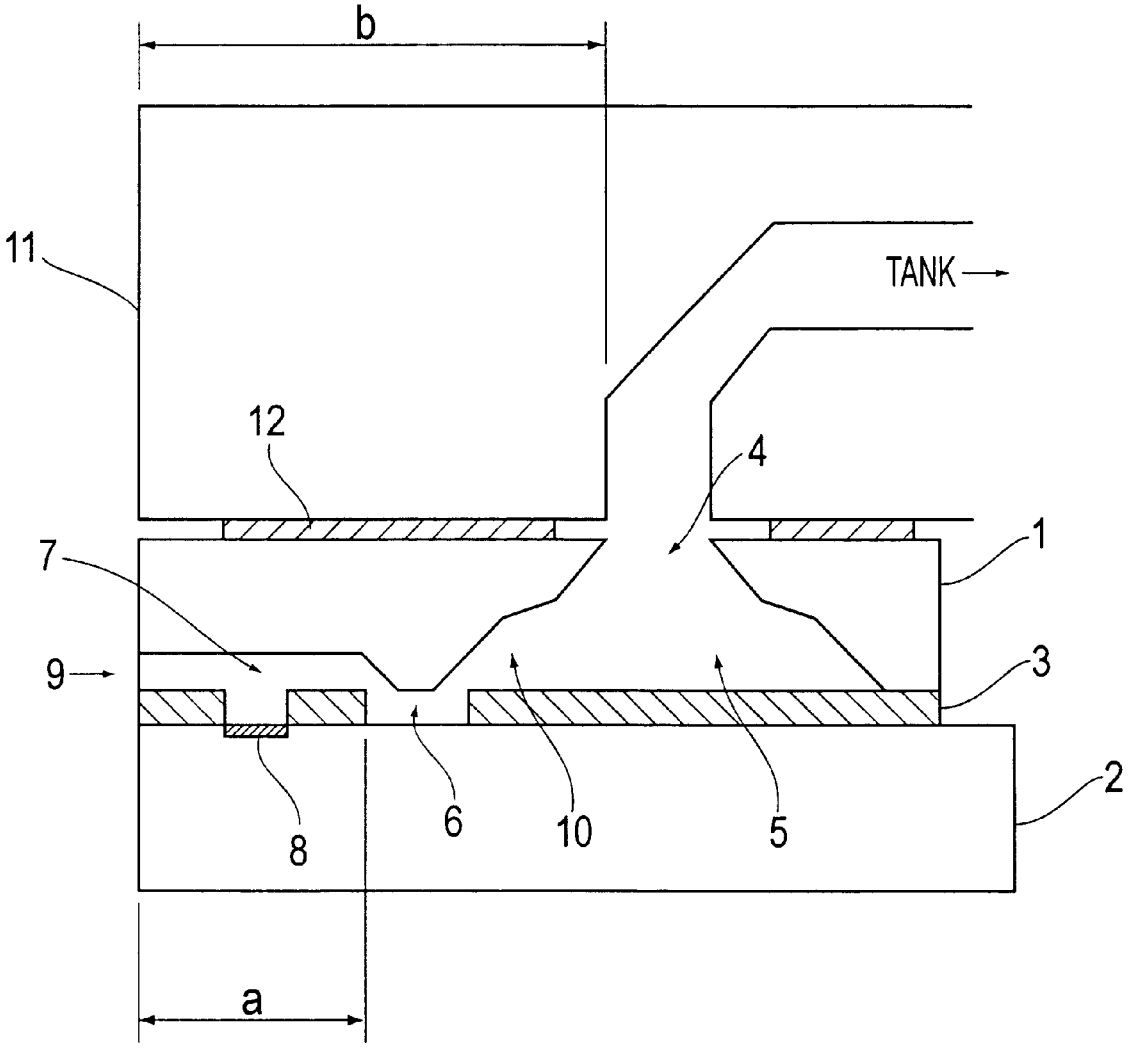
FIG. 21 PRIOR ART
FIG. 21 is a cross sectional view showing a liquid jet recording apparatus equipped with a manifold.
Figure 22A:
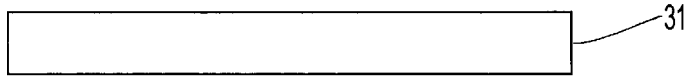
FIG. 22A PRIOR ART
FIGS. 22A to 22I are views showing sequential steps of a method for fabricating a liquid channel substrate of a conventional liquid jet recording apparatus.
Figure 22B:
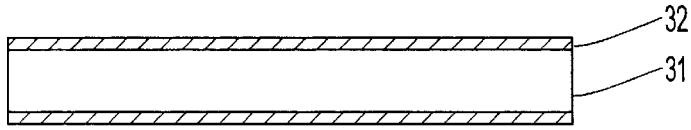
FIG. 22B PRIOR ART
Figure 22C:
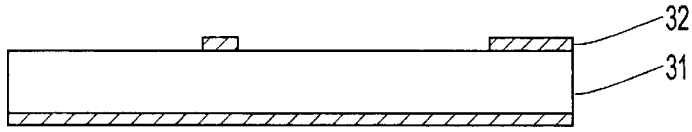
FIG. 22C PRIOR ART
Figure 22D:
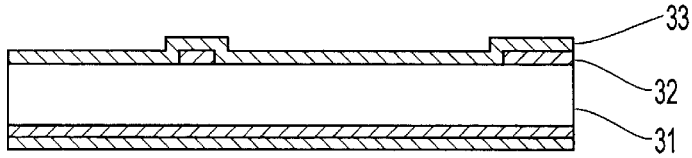
FIG. 22D PRIOR ART
Figure 22E:
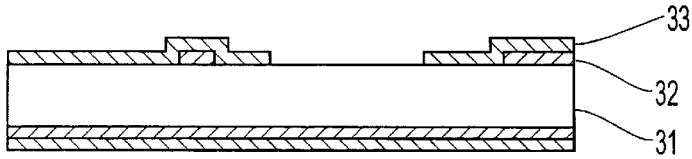
FIG. 22E PRIOR ART
Figure 22F:
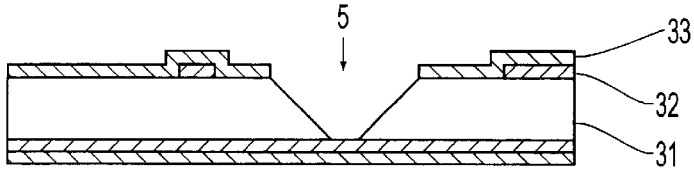
FIG. 22F PRIOR ART
Figure 22G:
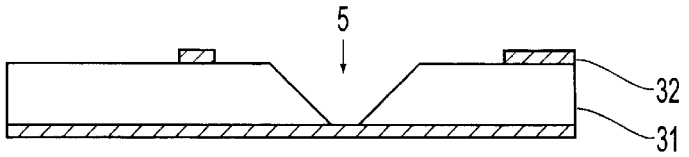
FIG. 22G PRIOR ART
Figure 22H:
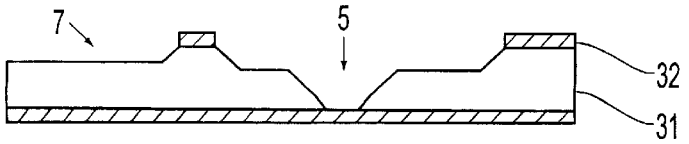
FIG. 22H PRIOR ART
Figure 22:
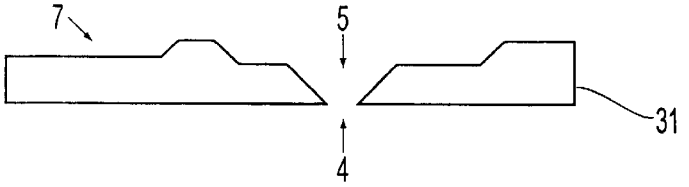
FIG. 22 I PRIOR ART
Figure 23:
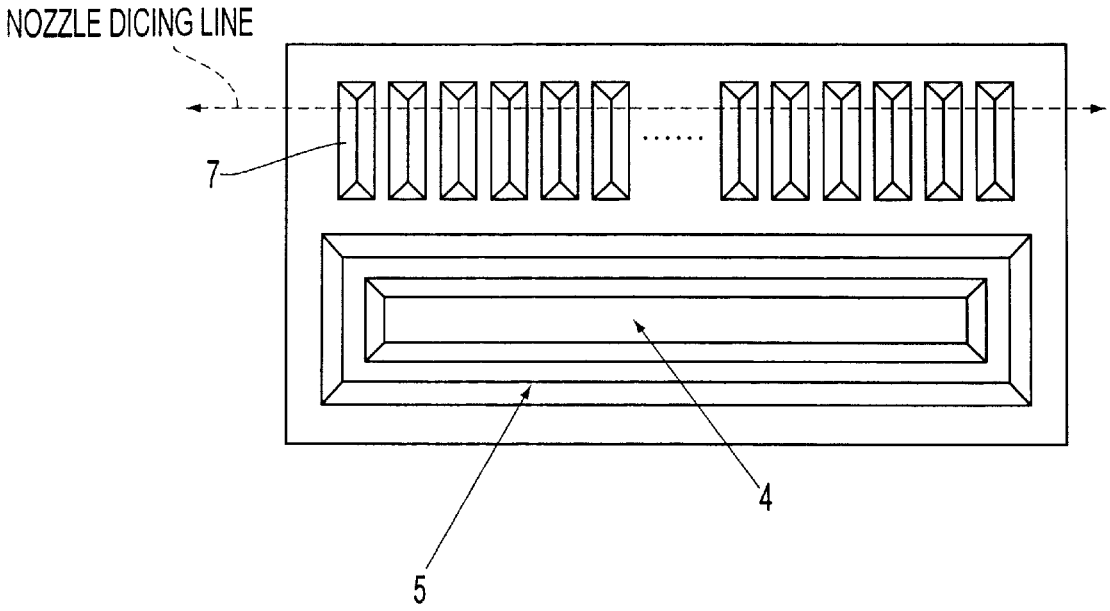
FIG. 23 PRIOR ART
FIG. 23 is a plan view exemplarily showing a silicon substrate 31 to be used as the liquid channel substrate of the conventional liquid jet recording apparatus.

As already stated referring to FIG. 21, where the length b between the nozzle surface having the discharge orifices 9 therein and the liquid inlet 4 is small, there is a danger that the adhesive 12 enters the apparatus inside through the liquid inlet 4 in the step of bonding the manifold 11 to the flow channel substrate 1 by adhesive 12. If the adhesive 12 enters, problem possibly arises in liquid ejection. To avoid this, it is required to secure at least a predetermined length for the length b. The crystal orientation of the Si substrate and the use of the wet anisotropic etching process determine an angle of each slanted surface of the depression, located closer to the common liquid chamber 5, and also the length or distance from the discharge orifice 9 to the common liquid chamber 5.

In the first embodiment, the common liquid chamber 5 formed by the wet anisotropic etching process is directly connected to the individual liquid flow channels 7. Because of this, the liquid flow channel 7 is liable to be long. This structural feature possibly produces the following disadvantages: the flow channel resistance of the liquid flow channel 7 is increased; the liquid re-supply performance is degraded and hence the print frequency (printing speed) is reduced; and the energy efficiency is reduced.

Possible approaches to reduce the flow channel resistance of the liquid flow channel 7 are to increase the etching depth or to reduce the distance or the length of the liquid flow channel 7. For the approach to increase the etching depth, the etching depth that one RIE process can produce is fixed. Therefore, it is compelled to change the profile (area) of the discharge orifice 9 is compelled. The profile change greatly affects the jetting characteristic of the apparatus, and hence the profile must be changed within a greatly restricted range. The approach to reduce the length of the liquid flow channel 7 inevitably makes the common liquid chamber 5 closer to the discharge orifice 9. The distance b from the nozzle surface to the liquid inlet 4 is reduced, and the problem of obstructing the liquid by the adhesive 12 in the flow channel created in the step of bonding the manifold 11 emerges.

In the second embodiment, the wet anisotropic etching process is carried out two times, for example. The depressions 43 are formed in the liquid flow channels 7 by the second wet anisotropic etching process. At this time, in connecting the liquid flow channels 7, together with the depressions 43, to the common liquid chamber 5, the stepped portion 10 of the great etching depth intervenes between them. Because of this, the passage ranging from the ends of the liquid flow channels 7 located closer to the common liquid chamber 5 to the common liquid chamber 5 may be broadened in width. This fact leads to reduction of the flow channel resistance by the presence of the stepped portion 10. The presence of the stepped portion 10 increases the length b between the nozzle surface and the liquid inlet 4. Therefore, in the step of bonding the manifold 11 by the adhesive 12 as shown in FIG. 21, there is no chance that the adhesive 12 enters the apparatus inside through the liquid inlet 4 and causes liquid ejection trouble. The resultant advantage is improvement of the production yield. Further, the reduction of the channel length a of the liquid flow channel 7 reduces the flow channel resistance of the liquid flow channel 7. This leads to improvement of the liquid re-supply characteristic and the printing speed.

In this embodiment, the depressions 43, together with the stepped portions 10, are formed by the second wet anisotropic etching process to thereby form the side walls or surfaces slanted toward the discharge orifices 9. If necessary, the process for forming the depressions 43 maybe different from that for forming the stepped portions 10. The etching process used is optional; another RIE process may used which is different from that for forming the liquid flow channels 7.

In the liquid jet recording apparatus of the second embodiment, as shown, the liquid flow channels 7 are communicatively connected to the common liquid chamber 5 through the stepped portion 10. In this case, the liquid flow channel is linear in configuration. Each liquid flow channel 7 includes a front constriction 41 and a rear constriction 42. The space above the heating resistor element 8 is vertically extended in the drawing. The space is also relatively reduced in height at the portions of the front constriction 41 and the rear constriction 42.

The structures of the front constriction 41 and the rear constriction 42 are the same as of those in the first embodiment. The portion of the rear constriction 42 located closer to the common liquid chamber 5 is gradually reduced in width when viewed in plan toward the discharge orifice 9. This configuration allows the liquid to smoothly flow from the common liquid chamber 5 to the space above the heating resistor element 8 through the stepped portion 10, to thereby avoid the degradation of the liquid re-supplying performance. Another portion of the rear constriction 42, located closer to the discharge orifice 9, is shaped to be substantially orthogonal to the direction of the liquid flow. The shape of this portion of the rear constriction 42 blocks the propagation of a pressure, which is generated during the growing of bubbles generated above the heating resistor element 8, toward the common liquid chamber 5, while guiding the pressure toward the discharge orifice 9. With this structure, the pressure generated during the bubble growing is efficiently utilized and hence the energy efficiency of the apparatus is improved. Additionally, it lessens an adverse effect on other liquid flow channels, viz., cross talk. These functions are further enhanced by the presence of the slanted surfaces of the depression 43, located closer to the common liquid chamber 5.

The front constriction 41 of each liquid flow channel 7 becomes narrow toward its associated discharge orifice 9 when viewed in plan. The front constriction 41 thus configured functions to concentrate the pressure, which is produced during the growing of bubbles that are generated above the heating resistor element 8, into the discharge orifice 9. As a result, the energy efficiency of the apparatus is improved and a spouting speed of a liquid drop that is spouted out of the discharge orifice 9 is increased. The increase of the spouting speed stabilizes the recording or printing operation and keeps the print quality high.

Also in the second embodiment, it will readily be understood that the configurations of the front constriction 41 and the rear constriction 42 are not limited to the illustrated ones, but these constrictions may take other suitable configurations. The front constriction 41 and/or the rear constriction 42 may be omitted, if necessary.

The cross section of each discharge orifice 9 is rectangular as shown in FIG. 8 since the trenches used as the liquid flow channels 7 are formed in the silicon substrate 31, by the RIE process. The individual liquid jet recording apparatuses each as shown in FIG. 8 are produced by dicing, and then the surface having discharge orifices 9 (nozzle surface) of the apparatus is sometimes subjected to a surface treatment. To the surface treatment, the nozzle surface of the liquid jet recording apparatus is immersed into a surface treatment solution, and the treatment liquid sticks to the nozzle surface. In this case, the coating around the discharge orifices 9 being rectangular in cross section is more uniform than that around the discharge orifices 9 being triangular.

In the liquid jet recording apparatus thus constructed, liquid enters the common liquid chamber 5 through the liquid inlet 4 and flows to the liquid flow channel 7 by way of the stepped portion 10. The liquid passes through the constriction portion the slanted surface or side wall of the depression 43, located closer to the common liquid chamber 5, and the rear constriction 42, and reaches the space above the heating resistor element 8. The liquid is heated by the heating resistor element 8 to generate air bubbles in the liquid. A pressure is generated when the bubbles grow, and by the pressure, the liquid is constricted in three directions by the slanted surface of the depression 43 that is located closer the discharge orifice 9 and the rear constriction 42, and is ejected through the discharge orifice 9.

Figures 10A, 10B, 10C, 10D:
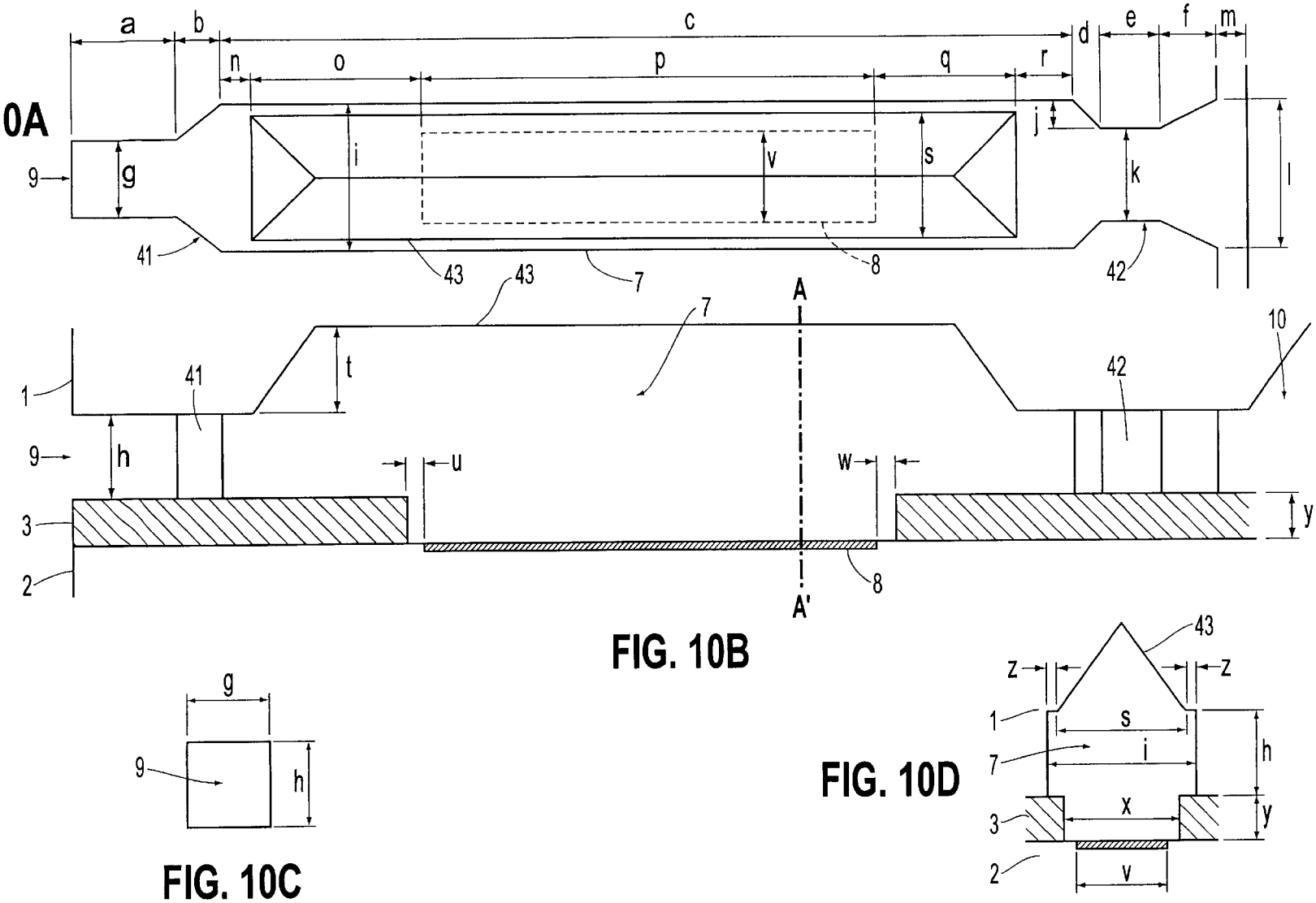
FIGS. 10A to 10D are views showing a specific flow channel structure used in the liquid jet recording apparatus of the second embodiment of the present invention.

FIGS. 10A to 10D are views showing a specific flow channel structure used in the liquid jet recording apparatus of the second embodiment of the present invention. FIG. 10A is a plan view showing one liquid flow channel 7 formed in the flow channel substrate 1. FIG. 10B is a cross sectional view showing the liquid flow channel 7 shown in FIG. 10A. FIG. 10C is a front view showing the liquid flow channel 7. FIG. 10D is a cross sectional view taken on line A–A' in FIG. 10B.

The liquid flow channel 7 is formed as a trench: it has the height (h) of 15 $\mu$m (h=15 $\mu$m); includes a segment of 26 $\mu$m wide (i) (i=26 $\mu$m) and 15 $\mu$m long (c) (c=15 $\mu$m); and it has a front constriction 41 formed at the front of the trench and a rear constriction 42 formed at the rear thereof. The front constriction 41 includes a first segment where the width is gradually reduced to the front up to the width g of 14 $\mu$m (g=14 $\mu$m) over the length b of 8 $\mu$m (b=8 $\mu$m), and a second segment as a flow channel of 14 $\mu$m wide and 18 $\mu$m long (a) (a=18 $\mu$m). This flow channel is opened at its extremity to form a square, discharge orifice 9. The discharge orifice 9 is: g=14 $\mu$m and h=15 $\mu$m (FIG. 10C. The rear constriction 42 includes first to third segments. In the first segment located closer to the discharge orifice 9, the width is gradually reduced (by 5 $\mu$m in width (j) (j=5 $\mu$m)) to the rear over the length d of 5 $\mu$m (d=5 $\mu$m) to have the width k of 16 $\mu$m (k=16 $\mu$m). The second segment has the width of 16 $\mu$m and the length e of 10 $\mu$m (e=10 $\mu$m). In the third segment located closer to the common liquid chamber 5, the width is gradually reduced (by 5 $\mu$m) to the rear over the length f of 10 $\mu$m (f=10 $\mu$m) to have the opening width l of 26 $\mu$m (l=26 $\mu$m). A slanted surface of the stepped portion 10 (formed by a wet anisotropic etching process) extends from a position spaced apart from the rear end of the third segment by the distance m of about 5 $\mu$m (m=5 $\mu$m).

A depression 43 to be formed in the liquid flow channel 7 is formed in the segment of 26 $\mu$m wide (i=26 $\mu$m) and ranges from a position spaced 5 $\mu$m (n=5 $\mu$m) apart from the end of the front constriction 41 closer to the common liquid chamber 5 to a position at a distance r of 10 $\mu$m (r=10 $\mu$m) from the end of the rear constriction 42 closer to the discharge orifice 9. The width s of the depression 43 is 22 $\mu$m (s=22 $\mu$m). The horizontal sides of the depression 43 are each spaced 2 $\mu$m (z=2 $\mu$m) from the side walls of the liquid flow channel 7 which face the horizontal sides, respectively. The depression 43 is defined by surfaces slanted at angle of 54.7□, determined by the characteristic of the wet anisotropic etching process, and its height t is about 5.5 $\mu$m (t □ 15.5 $\mu$m). The slanted surface of the depression 43 located closer to the discharge orifice 9 cooperates with the front constriction 41 to constrict the liquid flow channel toward the discharge orifice 9. Further, the slanted surface of the depression 43 located closer to the common liquid chamber 5 cooperates with the rear constriction 42 to block the propagation of the pressure (generated in the liquid flow channel 7) toward the common liquid chamber 5.

A heating part of the heating resistor element 8 in the element substrate 2 ranges from a position at a distance (o) of 30 $\mu$m (o=30 $\mu$m) from the end of the depression 43 located closer to the discharge orifice 9 to a position at a distance (q) of 25 $\mu$m (q=25 $\mu$m) from the end of the same closer to the common liquid chamber 5. The heating part of the heating resistor element 8 has the length (p) of 80 $\mu$m (p=80 $\mu$m) and the width (v) of 16 $\mu$m (v=16 $\mu$m). The thick layer 3 layered on the element substrate 2 has a thickness (y) of 8 $\mu$m (y=8 $\mu$m). An area of a removed portion of the thick layer 3 is specified: One side of the area (closer to the discharge orifice 9 when viewed in the liquid flow direction) spaced 3 $\mu$m (u=3 $\mu$m) apart from the end of the heating part of the heating resistor element 8, located closer to the discharge orifice 9; The other side thereof (closer to the common liquid chamber 5) is spaced 3 $\mu$m (w=3 $\mu$m) apart from the end thereof opposite to the former end; and Both sides of the area are each spaced 2 $\mu$m from the corresponding sides of the heating part of the heating resistor element 8, and the width (x) of the area is 20 μm (x=20 μm). The removal portion is provided to efficiently transmit heat generated by the heating resistor element 8 to the liquid and to shape air bubbles generated above the heating resistor element 8.

The cross section of the liquid flow channel 7 thus specified and formed is as shown in FIG. 10D at a position above the heating part of the heating resistor element 8.

Figures 11A, 11B, 11C, 11D:
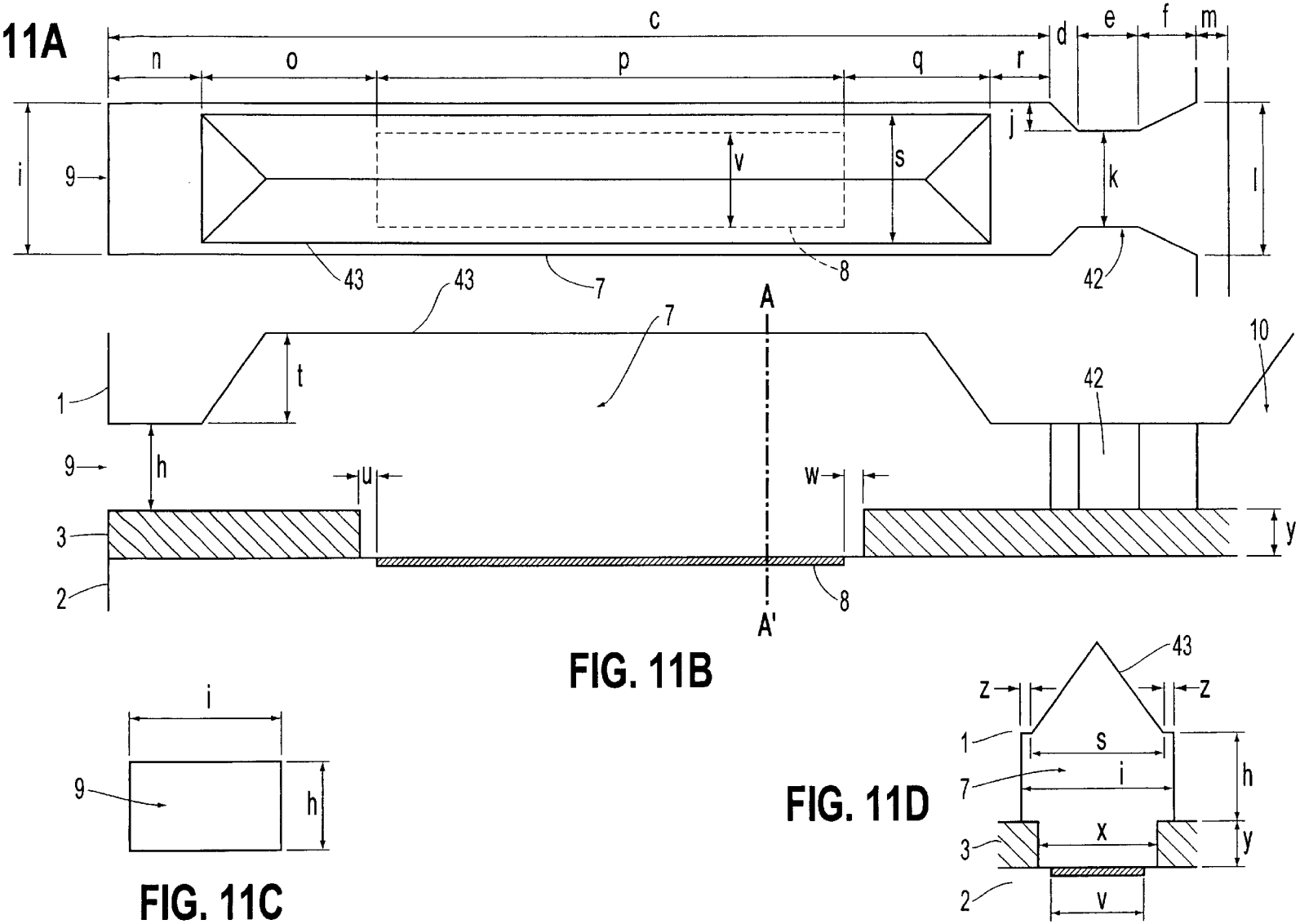
FIGS. 11A to 11D are views showing another specific flow channel structure used in the liquid jet recording apparatus of the second embodiment of the present invention.
Figure 12A:
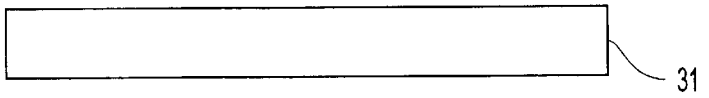
FIGS. 12A to 12H are views showing sequential steps of a method for fabricating a liquid channel substrate of the liquid jet recording apparatus of the second embodiment.
Figure 12B:
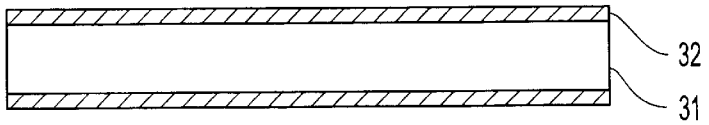
Figure 12C:
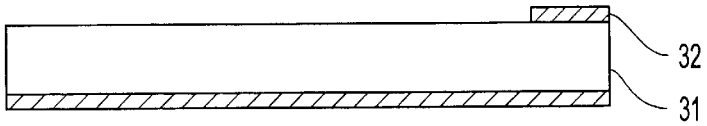
Figure 12D:
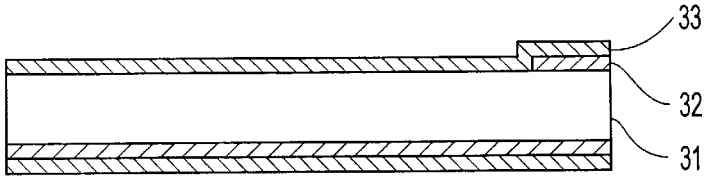
Figure 12E:
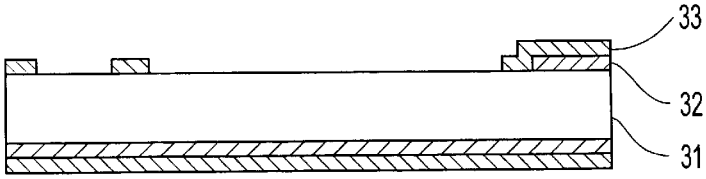
Figure 12F:
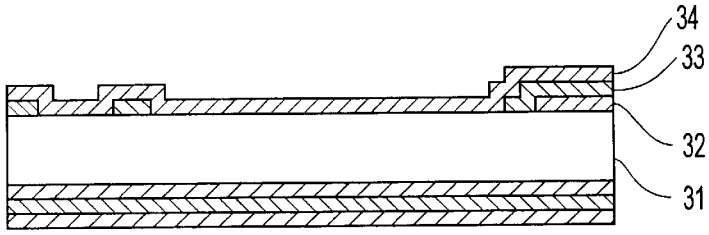
Figure 12G:
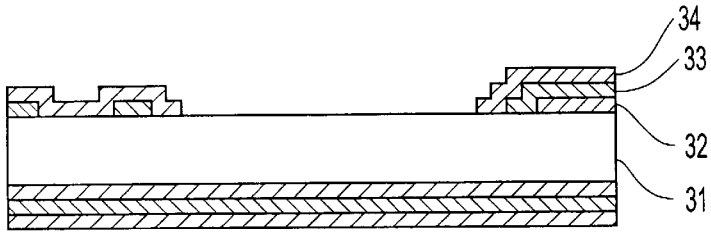
Figure 12H:
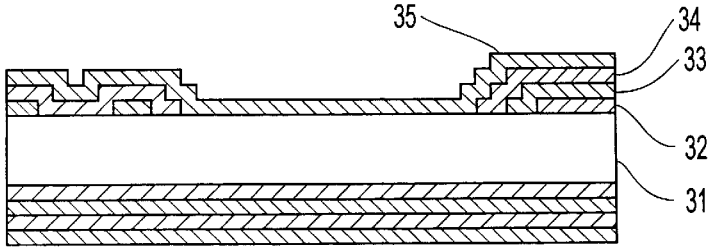

FIGS. 11A to 11D are views showing another specific flow channel structure used in the liquid jet recording apparatus of the second embodiment of the present invention. FIG. 11A is a plan view showing one liquid flow channel 7 formed in the flow channel substrate 1. FIG. 11B is a cross sectional view showing the liquid flow channel 7 shown in FIG. 11A. FIG. 11C is a front view showing the liquid flow channel 7. FIG. 11D is a cross sectional view taken on line A–A' in FIG. 11B. As described above, the front constriction 41 and/or the rear constriction 42 may be omitted, if necessary. The front constriction 41 is omitted in the illustrated structure. The dimensions of the respective portions of the liquid flow channel structure except the portions in the vicinity of the discharge orifice 9 are equal to those in the instance of FIG. 10.

The liquid flow channel 7 includes a segment having the width i of 26 μm (i=26 μm) and the length c of 160 μm ranging from the discharge orifice 9 to the rear constriction 42. The end of the segment opposite to the rear constriction 42 is opened to from the discharge orifice 9. The size of the discharge orifice 9 is: i=26 μm and h=15 μm. The depression 43 extends from a position at a distance n of 15 μm (n=15 μm) from the discharge orifice 9, and the size and configuration of the depression 43 are the same as in the instance of FIG. 10. The heating resistor element 8 and the removal portion of the thick layer 3 above the heating resistor element 8 are positioned relative to the depression 43 as in the instance of FIG. 10.

As referred to above, the front constriction 41 is not included in the structure of the liquid flow channel 7. The slanted surface of the depression 43, located closer to the discharge orifice 9, functions like the front constriction 41 to improve the liquid drop spouting characteristic.

The dimensions of the individual portions of the flow channel structure may be changed appropriately, if required. The function of the thick layer 3 is to merely protect the semiconductor integrated circuitry formed in the surface of the element substrate 2 against its corrosion by liquid. Therefore, it may be thin or omitted if allowed. A little or no depression of the thick layer 3 may be provided in association with the heating part of the heating resistor element 8.

FIGS. 12A to 12H and FIGS. 13A to 13H cooperate to show sequential steps of method for fabricating a liquid channel substrate of the liquid jet recording apparatus of the second embodiment. In those figures, like or equivalent portions are designated by like reference numerals in FIGS. 22A to 22I. Reference numeral 34 is an $SiO_2$ film and 35 is an SiN film.

1) FIG. 12A

An silicon substrate 31 to be used as the flow channel substrate 1 is arranged.

2) FIG. 12B

An $SiO_2$ film 32 as a first etch resistant masking layer is formed on the surface of the silicon substrate 31 by thermal oxide process.

3) FIG. 12C

Figure 14:
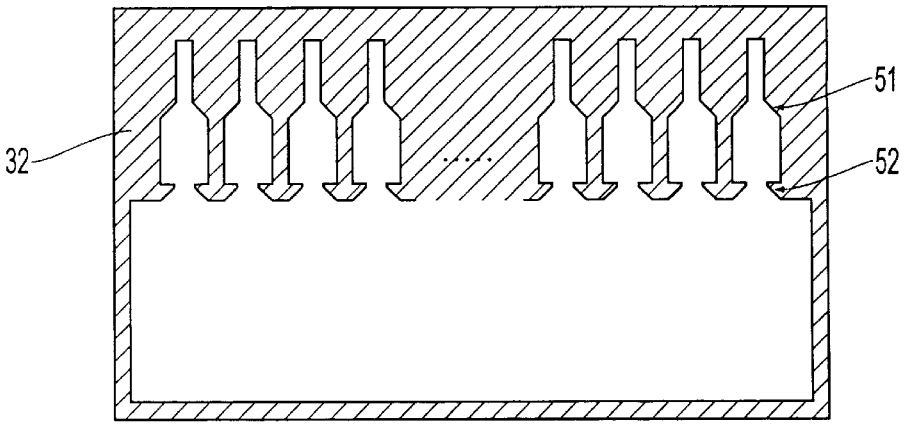
FIG. 14 is a plan view showing a pattern of an $SiO_2$ film 32 formed by the fabricating method.

The $SiO_2$ film 32 is patterned to form portions serving as liquid flow channels 7 and portions serving as common liquid chambers 5 by a photolithography method and a dry etching method. The Si substrate 31 used has a lattice face <100>. FIG. 14 is a plan view showing a pattern of the $SiO_2$ film 32 formed. In the figure, reference numeral 51 is a front constriction pattern and 52 is a rear constriction pattern. In the mask pattern by the $SiO_2$ film 32 in the second embodiment, the portion to be used as the common liquid chamber 5 and the liquid flow channel 7 interconnect the portion to be used as the liquid flow channels 7. A rear constriction pattern 52 is formed in the vicinity of a connection portion between it and the stepped portion 10, and a front constriction pattern 51 is formed just before a portion to be used as the nozzle with the discharge orifice 9. A portion of the liquid flow channel 7 to be used as the nozzle is narrowed.

4) FIG. 12D

An SiN film 33 to be used as a second etch resistant masking layer is formed on the structure by a low-pressure CVD method. The SiN film 33 has a thickness of about 300 nm.

5) FIG. 12E

Figure 15:
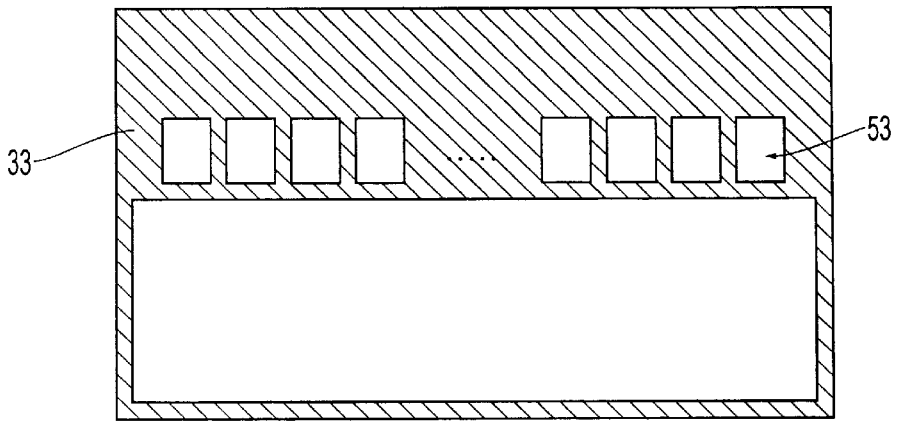
FIG. 15 is a plan view showing a pattern of an SiN film 33 formed by the fabricating method.

The SiN film 33 is patterned to form portions serving as common liquid chambers 5 and the stepped portion 10, and portions serving as depressions in the liquid flow channels 7 by a photolithography method and a dry etching method. FIG. 15 is a plan view exemplarily showing a pattern of the SiN film 33 formed. In the figure, numeral 53 designates a depression pattern. The SiN film 33 is used as a mask for preparatorily forming patterns with a depth, which are to be used as depressions 43, in the liquid flow channels 7. The SiN film 33 is removed of its portion defined by the area corresponding to the depression pattern 53. In this instance, the depressions 43 and the stepped portions 10 are formed in the same fabricating process step. Then, the portions of the SiN film to be used as common liquid chambers 5 and the stepped portions 10 are removed.

6) FIG. 12F

An $SiO_2$ film 34 as an $H_3PO_4$ resistant etching protecting layer (third etch resistant masking layer) is formed on the structure by a low-pressure CVD method. The $SiO_2$ film 34 formed has a thickness of about 500 nm.

7) FIG. 12G

The $SiO_2$ film 34 is patterned by a photolithography method and a dry etching method. The $SiO_2$ film 34 is left to such an extent as to cover the SiN film 33.

8) FIG. 12H

A second SiN film 35 to be used as a fourth etch resistant masking layer is formed on the structure by a low-pressure CVD method. The SiN film 35 formed has a thickness of about 300 nm.

9) FIG. 13A

Figure 16:
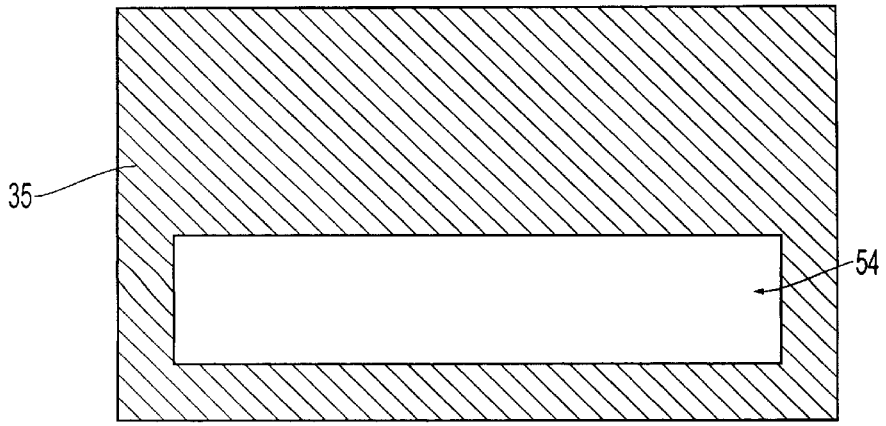
FIG. 16 is a plan view showing a pattern of an SiN film 35 formed by the fabricating method.

The structure is patterned to form regions in which common liquid chambers 5 are to be formed by a photolithography method and a dry etching method. FIG. 16 is a plan view showing a pattern of the SiN film 35 formed. In the figure, numeral 54 is a common liquid chamber pattern. The SiN film 35 is removed of only the regions to be used as the common liquid chambers 5 to form the common liquid chamber pattern 54. It is preferable that these regions are each smaller in size than an actual common liquid chamber 5.

10) FIG. 13B

With an etching mask of the SiN film 35, the silicon substrate 31 is etched in a KOH solution. The etching is continued to form a through-hole in the silicon substrate 31. The formed through-hole serves as a liquid inlet 4. The etching process used is the wet anisotropic etching process as in the conventional apparatus. The removal regions of the SiN film 35 is smaller than the actual common liquid chamber 5 by a predetermined value, and hence a common liquid chamber 5 formed here is smaller than the actual one by the same value. The through-hole formed has side walls slanted at given angles because of the nature of the wet anisotropic etching process. The etching is applied to one of the surfaces of the silicon substrate 31, so that the through-hole formed reduces in cross sectional area toward the liquid inlet 4. In the wet anisotropic etching process used here, an etching rate is higher than that in the RIE process, and hence is suitable for the etching made deep so as to form, for example, the through-hole passing through the flow channel substrate 1.

11) FIG. 13C

Subsequently, the SiN film 35 is selectively etched away in a phosphoric acid solution. In this etching process, the SiN film 33 is not etched since the $SiO_2$ film 34 to be used as the $H_3PO_4$ resistant etching protecting layer.

12) FIG. 13D

The $SiO_2$ film 34 is selectively etched away in an HF solution.

13) FIG. 13E

Figure 17:
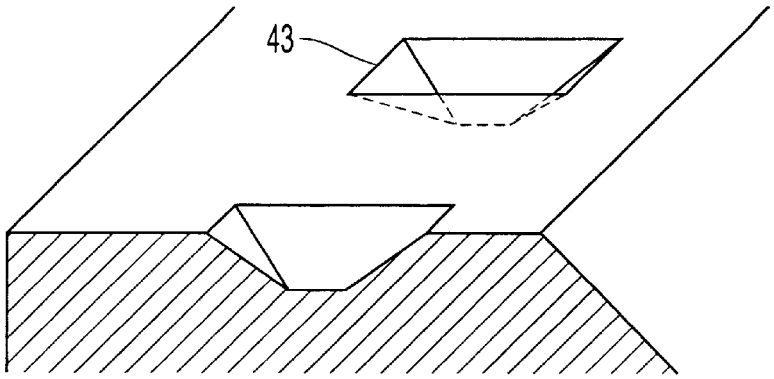
FIG. 17 is a broken, perspective view showing a portion to be used as a liquid flow channel 7 in the Si substrate when the second wet anisotropic etching process is carried out.

Using an etching mask of the SiN film 33, the silicon substrate 31 is etched in a KOH solution by a wet anisotropic etching process. The etching is made to a desired depth in the silicon substrate. The etching depth is about 200 $\mu$m, for example. The depth is shallower than the finishing depth. The portions of the thick layer 3 to be used as the common liquid chambers 5 and the stepped portions 10 have been removed as shown in FIG. 15. Therefore, a stepped portion 10 of a given depth may be formed in the side wall portion of the common liquid chamber 5. Further, the portions of the SiN film 33 serving as the depressions in the liquid flow channel 7 have been removed. Therefore, the portions serving as the depressions 43 in the liquid flow channels 7 are also etched to form patterns having a depth in the liquid flow channels 7. FIG. 17 is a broken, perspective view showing a portion to be used as a liquid flow channel 7 in the Si substrate when the second wet anisotropic etching process is carried out. In this figure, the etch resistant masking layer is omitted. As shown in FIG. 15, the depression pattern 53 may be formed as a rectangular pattern. The silicon substrate 31 is etched by a wet anisotropic etching process by using the thus patterned thick layer 3 as an etching mask to form three dimensionally shaped depressions 43 as shown in FIG. 17.

16) FIG. 13F

The SiN film 33 is selectively etched away in a phosphoric acid solution.

17) FIG. 13G

The Si substrate is RIE processed using an etching mask of the $SiO_2$ film 32. In this case, the etching depth may be about 20 $\mu$m. The RIE process can etch the regions other than those masked in a uniform thickness, while not dependent on the Si crystal orientation. In this etching process, the trenches substantially rectangular in cross section are formed in the Si substrate in accordance with the mask pattern shown in FIG. 14, and the patterns thus far made are also etched deep while keeping the patterns in shape. Therefore, the depressions formed in the regions serving as the liquid flow channels 7 are formed in the bottoms of the regions serving as the liquid flow channels 7, while keeping their shapes.

The forming accuracy of the liquid flow channels 7 greatly affects the liquid injection characteristic. The wet anisotropic etching process can accurately form a pattern rectangular in plan; however, it cannot accurately form a complicated planar pattern as shown in FIG. 14. The RIE process used in the present invention can accurately form a planar pattern of the liquid flow channels 7, even if complicated in shape, having a desired jetting characteristic. Further, the RIE process is free from such a disadvantage, essential to the wet etching process, that a planar size limits the etching depth. However, the RIE process cannot form a desired shape in the depth direction. To cope with this, the depressions 43 are accurately formed in the regions formed deep as shown in FIG. 17 in the previous process step, whereby predetermined patterns can be accurately formed also in the depth direction. Thus, the liquid flow channels 7 each having a three-dimensional structure can be formed.

Figure 13A:
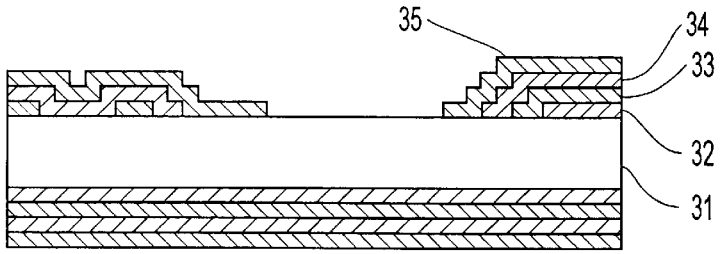
FIGS. 13A to 13H are views showing a sequence of method steps continued from the fabricating method of FIG. 12.
Figure 13B:
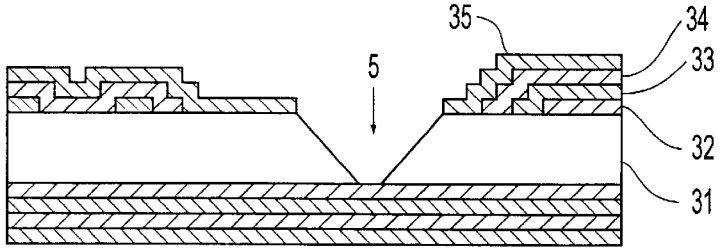
Figure 13C:
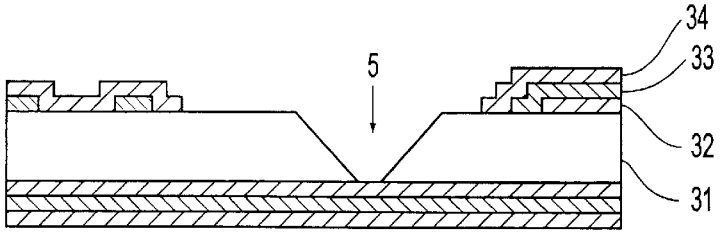
Figure 13D:
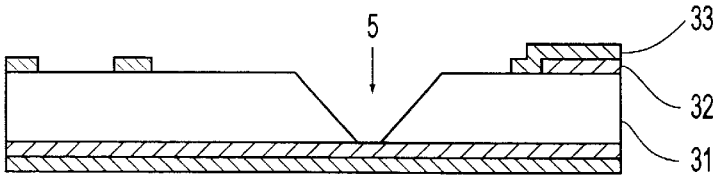
Figure 13E:
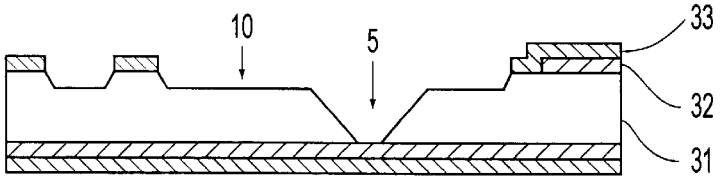
Figure 13F:
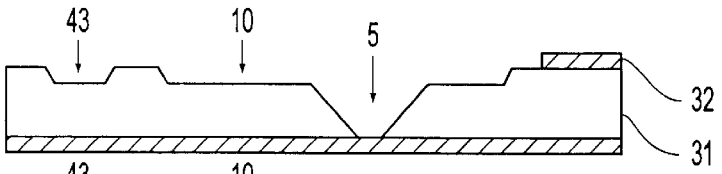
Figure 13G:
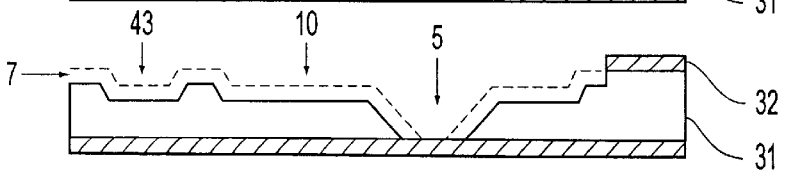
Figure 13H:
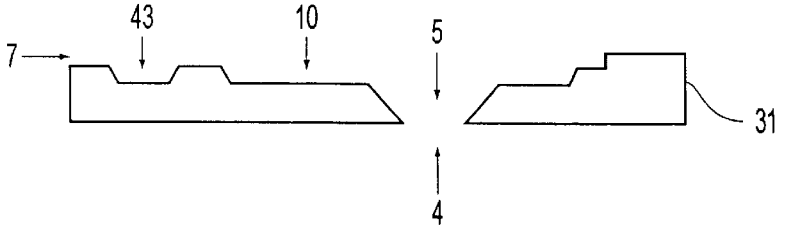

The stepped portions 10 are also etched by the RIE process to be deep, so that the volume of the common liquid chambers 5 is increased. The common liquid chamber 5 being smaller in size than the actual one and the stepped portions 10 are shallower than the actual ones, which are so formed in the steps of FIG. 13B and 13E, are enlarged and deepened to have the dimensions of the actual ones by the RIE process.

18) FIG. 13H

Figure 18:
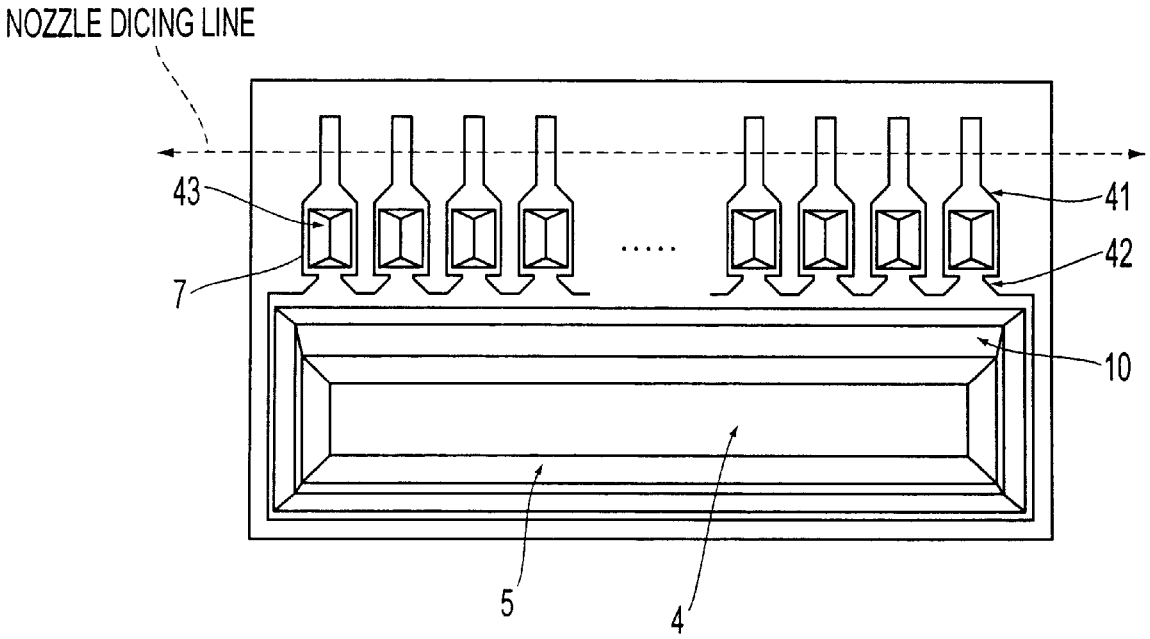
FIG. 18 is a plan view showing an silicon substrate 31 to be used as a flow channel substrate.

The $SiO_2$ film 32 is selectively etched away in a hydrofluoric acid solution to complete the fabrication method to the silicon substrate 31 to be used as the flow channel substrate 1. FIG. 18 is a plan view showing an silicon substrate 31 to be used as a flow channel substrate in the liquid jet recording apparatus of the second embodiment of the present invention. The silicon substrate 31 includes a number of liquid channel substrates each including the trenches serving as the liquid flow channels 7 having the front constrictions 41, the rear constrictions 42 and the depressions 43, the common liquid chamber 5, the through-hole, and the stepped portion 10 located between the liquid flow channel 7 and the liquid flow channel 7, those being formed by the fabricating method as shown in FIGS. 12A to 12H and FIGS. 13A to 13H. Thus, the RIE process can fabricate the liquid flow channels 7 even if those are complicated in shape in plan. Further, the combination of the wet anisotropic etching process and the RIE process can fabricate the structure being not even in the depth direction.

Another silicon substrate 31 including a number of element substrates 2 is fabricated by another fabricating method. Energy converting elements associated with the liquid flow channels 7, wires for supplying electric energy to the energy converting elements, and, if necessary, drive circuits are formed in the element substrate 2. In this instance, heating resistor elements are used for the energy converting elements. A thick layer made of polyimide, for example, is layered over the element substrate 2. The thick layer protects the elements, wires and the like in the element substrate 2 against liquid attack. The portions of the thick layer above the heating resistor elements are removed. Protecting films, for example, are formed on the heating resistor elements.

The silicon substrate 31 including a number of liquid flow channel substrates 1 and the silicon substrate including a number of element substrates are aligned with each other and bonded together. As the result of the bonding of those substrates, the flow channel substrate 1 and the thick layer 3 on the element substrates 2 defined the liquid flow channels 7. The substrate body resulting from the bonding of those substrates is cut into individual liquid jet recording apparatuses by dicing. A portion including an array of the liquid flow channels 7 in each liquid jet recording apparatus is cut along a nozzle dicing line (indicated by a broken line in FIG. 18) by dicing. The liquid flow channels 7 of the apparatus are opened in the cutting surface thereof. The openings of the liquid flow channels 7 serve as the discharge orifices 9.

Various components, e.g., a heat sink, are mounted on each of those separated liquid jet recording apparatuses. For example, a manifold 11 is attached to the apparatus as shown also in FIG. 21. A necessary distance from the nozzle surface containing the discharge orifices 9 to the liquid inlet 4 is secured without increasing the length of the liquid flow channel 7 by provision of the stepped portion 10. Therefore, a satisfactory bonding area is secured without increasing the flow channel resistance, and the production yield is improved.

As seen from the foregoing description, the present invention succeeds in providing a liquid jet recording apparatus of high jetting efficiency and high resolution performance by use of a flow channel substrate made of silicon, and further a method for fabricating the same apparatus at high production yield.

What is claimed is:

1. A liquid jet recording apparatus for jetting liquids comprising:

liquid flow channels, each of said liquid flow channels having a front constriction serving as a discharge orifice, a rear constriction and a heating resistor element being disposed on a bottom of each said liquid flow channel;

a common liquid chamber communicatively connected to said liquid flow channels in a linear fashion; wherein a ceiling wall of each of said liquid flow channels is vertically reduced in height at a position near said discharge orifice and at a liquid entrance thereof to form a depression having an elongated quadrilateral shape; and a cross sectional area of the front constriction and the rear constriction of each said liquid flow channel is rectangular.

2. The liquid jet recording apparatus of claim 1, wherein a cross sectional area of the ceiling of a portion of said liquid flow channels ranging from said liquid entrance to said discharge orifice is substantially triangular.

3. The liquid jet recording apparatus of claim 1, wherein a cross sectional area of a portion of said liquid flow channels ranging from said liquid entrance to said discharge orifice is asymmetrical, when vertically viewed, over entire length thereof.

4. The liquid jet recording apparatus of claim 1, wherein one of said position near said discharge orifice and said liquid entrance of said liquid flow channels is reduced in width when viewed in plan.

5. A liquid jet recording apparatus formed with a substrate body formed by bonding together a flow channel substrate and an element substrate, said apparatus comprising:

said flow channel substrate including a plural number of liquid flow channels, one end of each of said liquid flow channels serving as a discharge orifice, and a common liquid chamber communicatively connected to said plural number of liquid flow channels;

said element substrate including heating resistor elements;

said flow channel substrate including a plural number of trenches and a through-hole communicatively connecting to said plural number of trenches, each said trench having a front constriction at a fore end part, a rear constriction and a formed depression having an elongated quadrilateral shape; and a cross sectional area of the front constriction and the rear constriction of each said trench is rectangular; wherein when said flow channel substrate and said element substrate are bonded together, said trenches serve as liquid flow channels, and said through-hole serves as a common liquid chamber.

6. The liquid jet recording apparatus of claim 5, wherein a opening of each said liquid flow channels is rectangular in cross section.

7. The liquid jet recording apparatus of claim 5, wherein said constriction is planar in shape.

8. The liquid jet recording apparatus of claim 5, wherein heating resistor elements are formed on said liquid flow channels.

9. The liquid jet recording apparatus of claim 5, wherein said flow channel substrate is made of silicon.

* * * * *